US009305484B2

(12) United States Patent
Sano et al.

(10) Patent No.: US 9,305,484 B2
(45) Date of Patent: Apr. 5, 2016

(54) CAPACITIVE-LOAD DRIVING CIRCUIT AND PLASMA DISPLAY APPARATUS USING THE SAME

(71) Applicant: HITACHI MAXELL, LTD., Osaka, Ibaraki-shi (JP)

(72) Inventors: Yuji Sano, Kawasaki (JP); Akihiro Takagi, Kawasaki (JP); Tomokatsu Kishi, Kawasaki (JP); Toyoshi Kawada, Kawasaki (JP); Hirokazu Inoue, Kawasaki (JP)

(73) Assignee: HITACHI MAXELL, LTD., Osaka (JP)

( * ) Notice: Subject to any disclaimer, the term of this patent is extended or adjusted under 35 U.S.C. 154(b) by 0 days.

(21) Appl. No.: 14/557,883

(22) Filed: Dec. 2, 2014

(65) Prior Publication Data

US 2015/0084844 A1 Mar. 26, 2015

Related U.S. Application Data

(60) Continuation of application No. 13/325,983, filed on Dec. 14, 2011, now Pat. No. 8,928,646, which is a division of application No. 11/139,574, filed on May 31, 2005, now abandoned, which is a division of application No. 09/933,166, filed on Aug. 21, 2001, now Pat. No. 7,078,865.

(30) Foreign Application Priority Data

Sep. 29, 2000 (JP) ..... 2000-301015
Dec. 25, 2000 (JP) ..... 2000-393510

(51) Int. Cl.
*G09G 3/28* (2013.01)
*H05B 33/08* (2006.01)

(Continued)

(52) U.S. Cl.
CPC ..... *G09G 3/28* (2013.01); *G09G 3/2965* (2013.01); *H01J 11/26* (2013.01); *H05B 33/08* (2013.01);

(Continued)

(58) Field of Classification Search
CPC ..... G09G 3/28; G09G 3/2965; G09G 3/296; G09G 2310/0289; G09G 2330/021; G09G 2330/045; G09G 2330/02; H01J 11/26; H05B 33/08
USPC ..... 345/41, 46, 60–72, 211
See application file for complete search history.

(56) References Cited

U.S. PATENT DOCUMENTS 4,384,287 A 5/1983 Sakuma
5,081,400 A 1/1992 Weber et al.

(Continued)

FOREIGN PATENT DOCUMENTS

EP 1018722 A1 7/2000
JP 62-239196 10/1987

(Continued)

OTHER PUBLICATIONS

Notice of Allowance mailed Sep. 10, 2014 in related U.S. Appl. No. 13/325,983.

(Continued)

*Primary Examiner* — Christopher E Leiby
(74) *Attorney, Agent, or Firm* — Staas & Halsey LLP

(57) ABSTRACT

A plasma display apparatus including a capacitive load and a driving circuit is provided. The plasma display apparatus includes a driving power source supplying a drive voltage to the capacitive load and a reference potential terminal supplying a reference potential to the capacitive load. A drive IC is coupled to the driving power source.

3 Claims, 29 Drawing Sheets

(51) Int. Cl.
*H01J 11/26* (2012.01)
*G09G 3/296* (2013.01)

(52) U.S. Cl.
CPC ..... *G09G 3/296* (2013.01); *G09G 2310/0289* (2013.01); *G09G 2330/02* (2013.01); *G09G 2330/021* (2013.01); *G09G 2330/045* (2013.01)

(56) References Cited

U.S. PATENT DOCUMENTS

| | | | | |
|---|---|---|---|---|
| 5,095,305 | A | 3/1992 | Ide et al. | |
| 5,446,344 | A | 8/1995 | Kanazawa | |
| 5,463,408 | A | 10/1995 | Mio | |
| 5,583,527 | A | 12/1996 | Fujisaki et al. | |
| 5,714,844 | A | 2/1998 | Sato | |
| 5,828,353 | A | 10/1998 | Kishi et al. | |
| 5,861,861 | A | 1/1999 | Nolan et al. | |
| 5,900,694 | A | 5/1999 | Matsuzaki et al. | |
| 5,912,535 | A | 6/1999 | Peng | |
| 5,930,021 | A | 7/1999 | Matsubara et al. | |
| 6,028,573 | A | 2/2000 | Orita et al. | |
| 6,111,362 | A | 8/2000 | Coghlan et al. | |
| 6,121,943 | A | 9/2000 | Nishioka et al. | |
| 6,150,767 | A | 11/2000 | Huang | |
| 6,175,193 | B1 | 1/2001 | Kishita et al. | |
| RE37,083 | E | 3/2001 | Kanazawa | |
| 6,222,323 | B1 | 4/2001 | Yamashita et al. | |
| 6,297,597 | B1 | 10/2001 | Buell | |
| 6,304,038 | B1 | 10/2001 | Ide et al. | |
| 6,326,938 | B1 | 12/2001 | Ishida et al. | |
| 6,376,934 | B1 | 4/2002 | DeLurio | |
| 6,376,994 | B1 | 4/2002 | Ochi et al. | |
| 6,456,263 | B1 | 9/2002 | Hashimoto et al. | |
| 6,501,467 | B2 | 12/2002 | Miyazaki | |
| 6,522,314 | B1 | 2/2003 | Tomio et al. | |
| 6,556,177 | B1 | 4/2003 | Katayama et al. | |
| 6,580,409 | B1 | 6/2003 | Ito et al. | |
| 6,670,940 | B2 | 12/2003 | Kim | |
| 6,703,792 | B2 | 3/2004 | Kawada et al. | |
| 7,078,865 | B2 | 7/2006 | Sano et al. | |
| 2002/0126113 | A1* | 9/2002 | Iwasaki ..... | G09G 3/36 345/211 |

FOREIGN PATENT DOCUMENTS

| | | |
|---|---|---|
| JP | 03-085591 | 4/1991 |
| JP | 03-171194 | 7/1991 |
| JP | 04-245292 | 9/1992 |
| JP | 5-249916 | 9/1993 |
| JP | 5-273938 | 10/1993 |
| JP | 05-281921 | 10/1993 |
| JP | 9-34398 | 2/1997 |
| JP | 10-78767 | 3/1998 |
| JP | 10-187093 | 7/1998 |
| JP | 10-335726 | 12/1998 |
| JP | 2000-181401 | 6/2000 |
| JP | 2000-227777 | 8/2000 |

OTHER PUBLICATIONS

Office Action mailed Mar. 18, 2014 in related U.S. Appl. No. 13/325,983.
Office Action mailed Apr. 11, 2013 in related U.S. Appl. No. 13/325,983.
Office Action mailed Apr. 25, 2012 in related U.S. Appl. No. 13/325,983.
Office Action mailed Oct. 15, 2013 in related U.S. Appl. No. 13/325,983.
U.S Notice of Allowance mailed Feb. 27, 2006 in related U.S. Appl. No. 09/933,166.
U.S. Office Action mailed Sep. 7, 2005 in related U.S. Appl. No. 09/933,166.
U.S. Office Action mailed Dec. 22, 2004 in related U.S. Appl. No. 09/933,166.
U.S. Office Action mailed Oct. 4, 2004 in related U.S. Appl. No. 09/933,166.
U.S. Office Action mailed Jun. 15, 2004 in related U.S. Appl. No. 09/933,166.
U.S. Office Action mailed Nov. 18, 2003 in related U.S. Appl. No. 09/933,166.
U.S. Office Action mailed May 23, 2003 in related U.S. Appl. No. 09/933,166.
U.S. Office Action mailed Jan. 8, 2003 in related U.S. Appl. No. 09/933,166.
European Search Report dated Oct. 26, 2004 for corresponding Application No. 01307116.
Office Action dated Apr. 1, 2008 in co-pending U.S. Appl. No. 11/139,574.
Office Action dated Apr. 16, 2009 in co-pending U.S. Appl. No. 11/139,574.
Office Action dated Aug. 3, 2009 in co-pending U.S. Appl. No. 11/139,574.
Office Action dated Jan. 25, 2010 in co-pending U.S. Appl. No. 11/139,574.
Office Action mailed Oct. 19, 2012 in related U.S. Appl. No. 13/325,983.
Advisory Action mailed Mar. 5, 2013 in related U.S. Appl. No. 13/325,983.
Office Action mailed Mar. 28, 2011 in related U.S. Appl. No. 11/139,574.
U.S. Appl. No. 13/325,983, filed Dec. 14, 2011, Yuji Sano et al., Hitachi Maxell, Ltd.
Panasonic Service Manual, TH-42PW3/D3 (P87, 13.27.CI-Board Schematic Diagrams), 2000.
U.S. Office Action mailed Aug. 5, 2009 in related U.S. Appl. No. 11/350,848.
U.S. Office Action mailed Mar. 4, 2009 in related U.S. Appl. No. 11/350,848.
U.S. Office Action mailed Jul. 21, 2008 in related U.S. Appl. No. 11/350,848.
U.S. Office Action mailed Dec. 12, 2007 in related U.S. Appl. No. 11/350,848.
U.S. Office Action mailed Nov. 19, 2010 in related U.S. Appl. No. 11/139,574.
European Office Action mailed Jan. 27, 2014 in related European Application No. 01307116.2.
Japanese Laid-Open Publication No. 10-187093 dated Jul. 14, 1998.
Notice of Allowance mailed Sep. 10, 2014 in related U.S. Appl. No. 13/325,983 (now U.S. Pat. No. 8,928,646).
Office Action mailed Mar. 18, 2014 in related U.S. Appl. No. 13/325,983 (now U.S. Pat. No. 8,928,646).
Office Action mailed Apr. 11, 2013 in related U.S. Appl. No. 13/325,983 (now U.S. Pat. No. 8,928,646).
Office Action mailed Apr. 25, 2012 in related U.S. Appl. No. 13/325,983 (now U.S. Pat. No. 8,928,646).
Office Action mailed Oct. 15, 2013 in related U.S. Appl. No. 13/325,983 (now U.S. Pat. No. 8,928,646).
U.S. Office Action mailed Jul. 11, 2007 in related U.S. Appl. No. 11/350,848.
U.S. Office Action mailed Dec. 27, 2006 in related U.S. Appl. No. 11/350,848.
U.S Notice of Allowance mailed Feb. 27, 2006 in related U.S. Appl. No. 09/933,166 (now U.S. Pat. No. 7,078,865).
U.S. Office Action mailed Sep. 7, 2005 in related U.S. Appl. No. 09/933,166 (now U.S. Pat. No. 7,078,865).
U.S. Office Action mailed Dec. 22, 2004 in related U.S. Appl. No. 09/933,166 (now U.S. Pat. No. 7,078,865).
U.S. Office Action mailed Oct. 4, 2004 in related U.S. Appl. No. 09/933,166 (now U.S. Pat. No. 7,078,865).
U.S. Office Action mailed Jun. 15, 2004 in related U.S. Appl. No. 09/933,166 (now U.S. Pat. No. 7,078,865).
U.S. Office Action mailed Nov. 18, 2003 in related U.S. Appl. No. 09/933,166 (now U.S. Pat. No. 7,078,865).
U.S. Office Action mailed May 23, 2003 in related U.S. Appl. No. 09/933,166 (now U.S. Pat. No. 7,078,865).
U.S. Office Action mailed Jan. 8, 2003 in related U.S. Appl. No. 09/933,166 (now U.S. Pat. No. 7,078,865).

(56) References Cited

OTHER PUBLICATIONS

European Search Report dated Oct. 26, 2004 for corresponding Application No. 01307116.2.
Notice of Allowance mailed Feb. 1, 2010 in related U.S. Appl. No. 11/350,848.
Office Action dated Apr. 1, 2008 in related U.S. Appl. No. 11/139,574.
Office Action dated Apr. 16, 2009 in related U.S. Appl. No. 11/139,574.
Office Action dated Aug. 3, 2009 in related U.S. Appl. No. 11/139,574.
Office Action dated Jan. 25, 2010 in related U.S. Appl. No. 11/139,574.
Office Action mailed Oct. 19, 2012 in related U.S. Appl. No. 13/325,983 (now U.S. Pat. No. 8,928,646).
Advisory Action mailed Mar. 5, 2013 in related U.S. Appl. No. 13/325,983 (now U.S. Pat. No. 8,928,646).
Office Action mailed May 25, 2010 in related U.S. Appl. No. 11/139,574.
Office Action mailed Mar. 8, 2011 in related U.S. Appl. No. 11/139,574.
Office Action mailed Sep. 14, 2011 in related U.S. Appl. No. 11/139,574.
Notice of Allowance mailed Dec. 8, 2015 in related U.S. Appl. No. 14/557,883.
Final Office Action mailed Jul. 24, 2015 in related U.S. Appl. No. 14/557,883.
Office Action mailed Apr. 23, 2015 in related U.S. Appl. No. 14/557,883.
Panasonic Service Manual, TH-42PW3/D3 (P87, 13.27.Cl-Board Schematic Diagrams), 2000.
STMicroelectronics, CM17699, Color PDP Driver Module, Product Preview (P3, 3-CM17699 Schematic, and P8, 6-STV7699 Specifications, 6.6.2-Electrical Characteristics), Jan. 1999.
Notice of Allowance mailed Jan. 7, 2016 in related U.S. Appl. No. 14/557,883.

* cited by examiner

SINGLE-MATERIAL ELECTRODE

COMPOSITE-MATERIAL ELECTRODE

CAPACITIVE-LOAD DRIVING CIRCUIT AND PLASMA DISPLAY APPARATUS USING THE SAME

CROSS-REFERENCE TO RELATED APPLICATIONS

This application is a Continuation Application of pending application Ser. No. 13/325,983, filed on Dec. 14, 2011, which is a Divisional of application Ser. No. 11/139,574, filed on May 31, 2005, which is a Divisional of application Ser. No. 09/933,166, filed Aug. 21, 2001, now patented as U.S. Pat. No. 7,078,865, and claims the benefit of Japanese Application Nos. 2000-393510, filed Dec. 25, 2000 and 2000-301015, filed Sep. 29, 2000 in the Japanese Patent Office, the disclosures of which are incorporated by reference.

BACKGROUND OF THE INVENTION

1. Field of the Invention

The present invention relates to a capacitive-load driving circuit and a plasma display apparatus using the same, and more particularly, to a circuit technique capable of properly handling the temperature rise occurring due to the driving of capacitive loads in a plasma display panel, an electronic luminescence panel, and the like.

2. Description of the Related Art

Recently, a variety of display apparatuses have been researched and developed, and the research and development of thin flat display apparatuses, exemplified by plasma display panels (PDP) and electronic luminescence (EL) panels, has been proceeding. Among them, the PDP, with its ability to achieve a large-screen, fast-response display and its improved display quality, has been attracting attention as a display apparatus that has the potential of replacing the traditional CRT.

The PDPs are largely classified as AC or DC. The DC PDPs have the characteristic that the matrix discharge electrodes are exposed in each discharge cell and the electric field control of the discharge space in the cell is easy. On the other hand, the AC PDPs have the characteristic that the matrix discharge electrodes are covered with a dielectric layer, which reduces electrode degradation due to discharge and achieves a longer life. Further, a three-electrode panel construction (three-electrode surface-discharge AC-type PDP), in which a front plate with X electrodes and Y electrodes formed thereon in the horizontal line direction and a back panel with address electrodes in the vertical column direction are simply laminated together one on top of the other, has been commercially implemented, facilitating the construction of a higher-resolution display.

Incidentally, in a prior art technique for achieving power reduction in a pulsed capacitive-load driving circuit, it is known to provide a power recovery circuit that utilizes a phenomenon of resonance for energy transfer between load capacitance and inductance. One specific example of the power recovery technique suitable for a driving circuit where the load capacitance varies greatly for driving each individual load electrode by a mutually independent voltage in accordance with display image, as in an address electrode driving circuit, is the low power driving circuit disclosed in Japanese Unexamined Patent Publication (Kokai) No. 05-249916.

The prior art capacitive-load driving circuit recovers power by utilizing a phenomenon of resonance, but with the recent trend toward higher-resolution and larger-screen plasma display panels, the power consumption reduction design has been losing its effectiveness significantly. Specifically, when the output frequency of the driving circuit is increased to increase the resolution of the panel, it becomes necessary to reduce the resonance time in order to maintain the control performance of the panel. If the power consumption of the driving circuit cannot be reduced sufficiently, the cost involved in removing heat from various parts of the display, and therefore, the component cost, increases, and besides, this could lead to a situation where the display brightness is reduced due to the limit of the heat dissipation capability of the display apparatus itself, or where the advantage of the flat panel display, i.e., thin and light-weight construction, cannot be exploited to the full.

Furthermore, as the output frequency of the driving circuit increases, power consumption increases due to the generation of high-voltage pulses to drive the plasma display panel, and a temperature rise in the driving circuit (drive IC) becomes a serious concern.

The prior art and the problems associated with the prior art will be described in detail later with reference to accompanying drawings.

SUMMARY OF THE INVENTION

An object of the present invention is to provide a capacitive-load driving circuit capable of distributing a temperature rise (power consumption) in a circuit that drives a capacitive load. Another object of the invention is to provide a plasma display apparatus that uses such a capacitive-load driving circuit.

According to the present invention, there is provided a capacitive-load driving circuit including a configuration in which a driving power supply source is connected to an output terminal via a driving device, comprising a power distributing circuit inserted between the driving power supply source and the driving device.

According to the present invention, there is also provided a capacitive-load driving circuit including a configuration in which a reference potential point is connected to an output terminal via a driving device, comprising a power distributing circuit inserted between the reference potential point and the driving device.

The power distributing circuit may be a resistive element having an impedance whose value is not smaller than one-tenth of the value of a resistive component of the conducting impedance of the driving device. The power distributing circuit may be a high-power resistor having a capability to handle power higher than the allowable power of the driving device. The power distributing circuit may be a constant-current source.

The driving power supply source may output a plurality of different voltage levels in a selective manner. The power distributing circuit may include a plurality of power distributing units, one for each of the plurality of different voltage levels. Each of the power distributing units may have a function as a switch for selecting one of the plurality of different voltage levels. The driving device may be a device whose input withstand voltage is higher than an output voltage.

Further, according to the present invention, there is provided a capacitive-load driving circuit including a configuration in which a plurality of driving devices for driving a plurality of capacitive loads are formed in integrated-circuit form, wherein each of the driving devices is connected to a driving power supply source or a reference potential point via a power distributing circuit.

The capacitive-load driving circuit may further comprise a diode inserted between each of the capacitive loads and a corresponding one of the driving devices. Each of the power distributing circuits may be a resistive element having an impedance whose value is not smaller than one-tenth of the conducting impedance of the driving device divided by the number of driving devices connected to the power distributing circuit. Each of the power distributing circuits may be a high-power resistor having a capability to handle power higher than the allowable power of the driving device. Each of the power distributing circuits may be a constant-current source.

The driving power supply source may output a plurality of different voltage levels in a selective manner. The power distributing circuit may include a plurality of power distributing units, one for each of the plurality of different voltage levels. Each of the power distributing units may have a function as a switch for selecting one of the plurality of different voltage levels. The driving device may be a device whose input withstand voltage is higher than an output voltage.

A ground terminal of each of the integrated driving devices may be connected to the driving power supply source via the power distributing circuit. A ground terminal of each of the integrated driving devices may be connected to the reference potential point via the power distributing circuit. A series connection of each of the power distributing circuit and a switch device may be provided between each of the driving devices and the driving power supply source or the reference potential point.

The capacitive-load driving circuit may be constructed as a driving module containing a plurality of driving integrated circuits for driving the capacitive loads. Each of the driving integrated circuits may comprise a high-voltage output device whose input withstand voltage is increased up to a driving power supply voltage, and a flip-flop that drives a control input of the output device to a full-swing level either at the driving power supply voltage or at the reference potential. Each of the driving integrated circuits may include a buffer driven by a logic voltage, and wherein an output of the buffer may be connected to an input terminal of the each driving device, and the power distributing circuit to an inverting input terminal of the each driving device, thereby applying self-biasing to the driving device by a voltage drop occurring across the power distributing circuit. The capacitive-load driving circuit may further comprise a switch device inserted between the power distributing circuit and the driving power supply source or the reference potential point, and the switch being caused to conduct after the driving devices have been switched into a conducting state.

According to the present invention, there is provided a capacitive-load driving circuit including a configuration in which a driving power supply source is connected to an output terminal via a driving device, wherein the driving power supply source outputs a plurality of different voltage levels in a selective manner.

The driving power supply source may raise or lower an output voltage in steps by switching the output voltage between the plurality of voltage levels within a drive voltage amplitude, while retaining the ON/OFF states of the driving device.

According to the present invention, there is also provided a capacitive-load driving circuit for driving a capacitive load, connected to an output terminal, by a driving device, comprising a resistive impedance inserted in series to the output terminal.

The resistive impedance may provide an impedance whose value is not smaller than one-tenth of the value of a resistive component of the conducting impedance of at least one of the driving devices. The resistive impedance may be a distributed resistor showing a resistance value not smaller than three-tenths of the value of a resistive component of the conducting impedance of at least one of the driving devices. The capacitive-load driving circuit may further comprise a driving power supply source connected to the output terminal via the driving device, and a power distributing circuit inserted between the driving power supply source and the driving device.

Furthermore, according to the present invention, there is also provided a plasma display apparatus including a capacitive-load driving circuit used as an electrode driving circuit.

The capacitive-load driving circuit may be used as a driving circuit for driving address electrodes. The plasma display apparatus may be a three-electrode surface-discharge AC plasma display apparatus in which the address electrodes are formed on a first substrate and X and Y electrodes are formed on a second substrate; and thickness of a conductive layer of each of the address electrodes may be reduced to one half or less of the thickness of a conductive layer formed from the same material as the conductive layer of each of the X and Y electrodes. The plasma display apparatus may be a three-electrode surface-discharge AC plasma display apparatus in which the address electrodes are formed on a first substrate and X and Y electrodes are formed on a second substrate; and each of the address electrodes may be formed from a plurality of conductive metal layers, and an arbitrary one of the conductive metal layers is omitted.

In addition, according to the present invention, there is also provided an inductance-load driving circuit for driving an inductive load, connected to an output terminal, by a driving device, wherein a resistive impedance is inserted in series to the output terminal.

The resistive impedance may provide an impedance whose value is not smaller than one-tenth of the value of a resistive component of the conducting impedance of at least one of the driving devices.

According to an exemplary embodiment of the present invention, a plasma display apparatus including capacitive loads and a driving circuit includes a driving power source supplying a drive voltage to the capacitive load, a reference potential terminal supplying a reference potential to the capacitive load, a drive IC having a first input terminal coupled to the driving power source via a resistor that is an external device different from the drive IC, a second terminal coupled to the reference potential terminal without interposing a resistor, first and second switching devices, the first switching device being coupled to the first input terminal, and the second switching device being coupled to the second input terminal, and the drive IC having an output terminal, connected to each switching device, which selectively outputs the drive voltage or the reference potential by switching the first and second switching devices, wherein one of terminals of the first switching device is coupled to the first input terminal and the other of the terminals is coupled to the output terminal, one of terminals of the second switching device is coupled to the second input terminal and the other of the terminals is coupled to the other of the terminals of the first switching device and the output terminal, and the drive voltage and the reference potential are selectively supplied to the capacitive load via the output terminal according to control signals inputted to control terminals of the first and second switching devices, wherein the drive IC includes one each of the first input terminal and the second input terminal, n (n is an integer larger than or equal to 2) each of the first and second switching devices and the output terminals, and each of the n sets of the first and second driving devices and the output terminals correspond to each of n loads of the capacitive loads, and the drive voltage is supplied to each of the plurality of capacitive loads corresponding to each of the n sets from the driving power source via the resistor, the first input terminal, the each first switching device of the n sets, and the output terminal.

According to an exemplary embodiment of the present invention, a plasma display apparatus having a plurality of capacitive loads and a driving circuit includes a plurality of driving devices driving a plurality of capacitive loads in an integrated-circuit form; a driving power source supplying a drive voltage to the capacitive load, a reference potential source supplying a reference potential to the capacitive loads, wherein the integrated circuit includes a first input terminal coupled to the driving power source via a resistor that is an external device different from the drive IC, one second input terminal coupled to the reference potential terminal without interposing a resistor, and a plurality of output terminals respectively corresponding to the plurality of driving devices, each of the plurality of driving devices includes a first switching device having one of the terminals coupled to the first input terminal and the other terminals coupled to the output terminal; and a second switching device having one of terminals coupled to the second input terminal and the other of the terminals coupled to the other of the terminals of the first switching device and the output terminal, and the drive voltage and the reference potential are selectively supplied to the capacitive load via the output terminal according to control signals inputted to control terminals of the first and second switching devices, and wherein the drive voltage is supplied to each of the plurality of capacitive loads corresponding to each of the plurality of driving devices from the driving power source via the resistor, the first input terminal, each of the first switching devices of the plurality of driving devices, and the output terminal.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

Before proceeding to the detailed description of the preferred embodiments of the invention, problems associated with a prior art capacitive-load driving circuit and a plasma display apparatus using the same will be described first.

Figure 1:
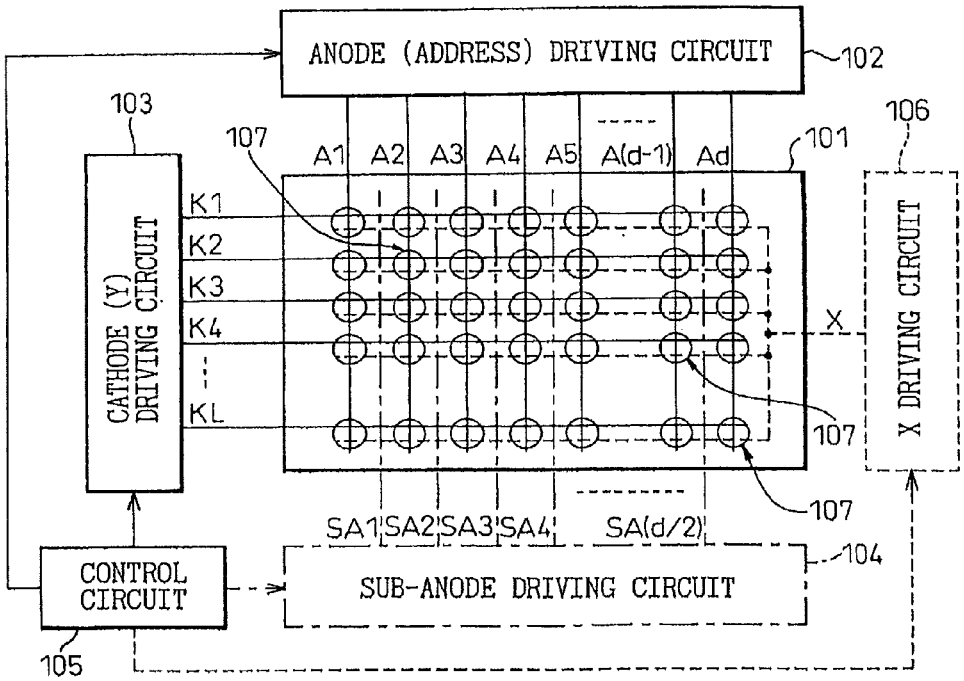
Fig.1 (PRIOR ART)
FIG. 1 is a block diagram schematically showing the entire configuration of a plasma display apparatus.

FIG. 1 is a block diagram schematically showing the entire configuration of the plasma display apparatus. In FIG. 1, reference numeral 101 is a display panel, 102 is an anode (address) diving circuit, 103 is a cathode (Y) driving circuit, 104 is a sub-anode driving circuit, 105 is a control circuit, 106 is an X driving circuit, and 107 is a discharge cell.

The following description deals primarily with the address driving circuit (address drive IC) of the plasma display apparatus, but it will be recognized that the capacitive-load driving circuit of the invention can be applied not only for the address driving circuit of the plasma display apparatus, but also for other circuits for driving the capacitive loads (discharge cells), such as the X driving circuit and the Y driving circuit; furthermore, the circuit technique of the invention can be applied extensively to circuits for driving various capacitive loads other than those in the plasma display apparatus, for example, to circuits for driving logic gates formed from MOS transistors (the gate of each transistor to be driven can be considered a capacitor, with which a capacitor or the like, parasitic on an interconnection, etc., is combined to form a capacitive load).

The configuration shown in FIG. 1 is depicted so as to be applicable to both an AC plasma display apparatus and a DC plasma display apparatus; the anode driving circuit 102, cathode driving circuit 103, and sub-anode driving circuit 104 are for the DC plasma display apparatus, and the address driving circuit 102, Y-electrode driving circuit 103, and X-electrode driving circuit 106 are for the AC plasma display apparatus. The display panel 101 and control circuit 105 are shown for both AC and DC plasma display apparatuses.

More specifically, the display panel (plasma display panel: PDP) 101 is largely classified as AC or DC. The DC PDP has the characteristic that the matrix discharge electrodes are exposed in each discharge cell 107 and the electric field control of the discharge space in the cell is easy. Furthermore, in the case of the DC PDP, since the electrode polarities are limited to the anode A1-Ad and the cathode K1-KL, it is easy to optimize the discharge glow state and, by also utilizing a technique that produces a preliminary discharge using a sub-anode electrode SA1-SA(d/2), etc. shared between adjacent anode electrodes, the main discharge voltage to be applied between the anode and cathode to produce a display can be reduced and, in addition, the display can be made faster. The driving section comprises, as described above, three driving circuits, i.e., the anode driving circuit 102, cathode driving circuit 103, and sub-anode driving circuit 104, and the control circuit 105 for controlling these driving circuits.

On the other hand, the AC PDP has the characteristic that the matrix discharge electrodes are covered with a dielectric layer, which reduces electrode degradation due to discharge and achieves a longer life. Furthermore, a three-electrode panel construction (three-electrode surface-discharge AC PDP), in which a front plate with X electrodes and Y electrodes formed thereon in the horizontal line direction and a back panel with address electrodes in the vertical column direction are simply laminated together one on top of the other, has been commercially implemented, facilitating the construction of a higher-resolution display. The driving section comprises, as described above, three driving circuits, i.e., the address driving circuit 102 for selecting a display cell in the column direction according to the video data, the Y driving circuit 103 for selectively scanning each line, and the X driving circuit 106 for applying main display sustain pulses simultaneously to all the lines, and the control circuit 105 for controlling these driving circuits.

Here, the drive terminals of all the electrodes, except the dummy electrodes at the panel edge, are DC isolated from circuit ground, and capacitive impedance is dominant as the load for each driving circuit.

In a prior art technique for achieving power reduction in a pulsed capacitive-load driving circuit, it is known to provide a power recovery circuit that utilizes a phenomenon of resonance for energy transfer between load capacitance and inductance. One specific example of the power recovery technique suitable for a driving circuit where the load capacitance varies greatly for driving each individual load electrode by a mutually independent voltage in accordance with display image, as in an address electrode driving circuit, is the low power driving circuit disclosed in Japanese Unexamined Patent Publication (Kokai) No. 05-249916.

Figure 2:
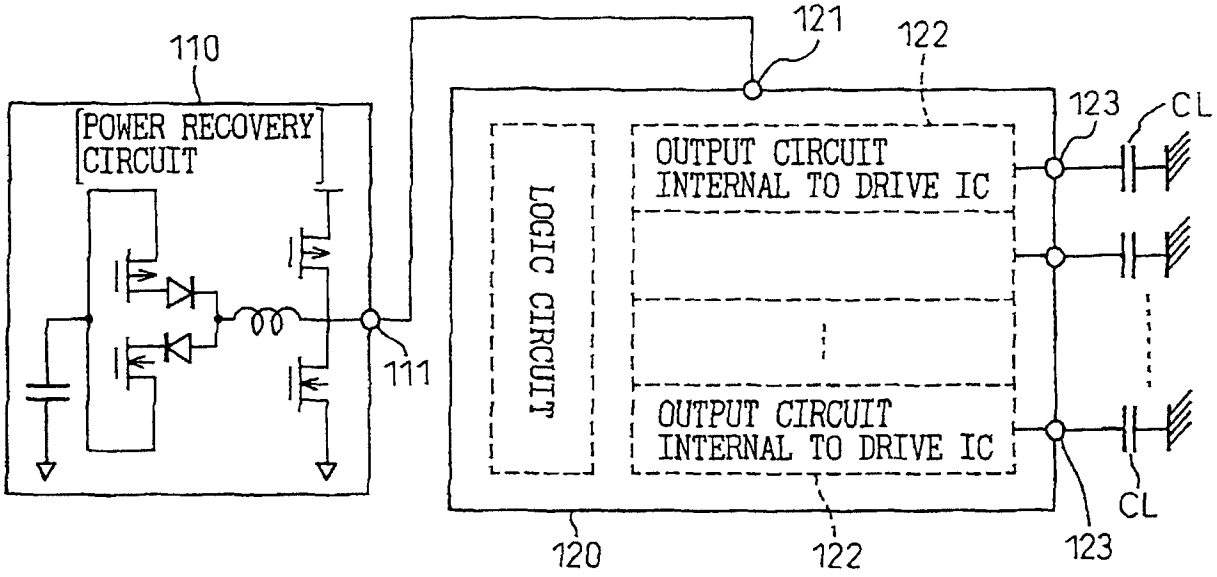
Fig.2 (PRIOR ART)
FIG. 2 is a block diagram showing an example of a prior art driving circuit for a plasma display apparatus.

FIG. 2 is a block diagram showing one example of the prior art driving circuit for a plasma display apparatus. The low power driving circuit disclosed in Japanese Unexamined Patent Publication No. 05-249916 is shown here. In FIG. 2, reference numeral 110 is a power recovery circuit, 111 is an output terminal of the power recovery circuit, 120 is an address driving circuit (address drive IC), 121 is a power supply terminal of the address drive IC, 122 is an output circuit internal to the drive IC 120, and 123 is an output terminal of the address drive IC. Reference character CL indicates a load capacitance consisting of a discharge cell, interconnect capacitance, etc.

In the prior art capacitive-load driving circuit shown in FIG. 2, power consumption is reduced by driving the power supply terminal 121 of the address drive IC 120 using the power recovery circuit 110 that contains a resonance inductance. The power recovery circuit 110 normally outputs a constant address driving voltage when producing an address discharge on an address electrode in the plasma display panel, and reduces the voltage at the power supply terminal 121 to ground level before the switching state of the output circuit 122 internal to the address drive IC changes. At this time, resonance occurs between the resonance inductance within the power recovery circuit 110 and the combined load capacitance (for example, maximum n×CL) of an arbitrary number (for example, maximum n) of address electrodes driven to the high level, and this works to greatly reduce the power consumption of the output device in the output circuit 122 internal to the address drive IC.

In the prior art capacitive-load driving circuit where the supply voltage to the address drive IC is set to a constant level, power equal to the amount of change in the stored energy in the load capacitor CL before and after switching a discharge cell is all consumed in the resistive impedance section of the charge/discharge current path; when the power recovery circuit 110 is used, the amount of potential energy stored in the load capacitor, relative to the intermediate potential of the address driving voltage that serves as the resonance center of the output voltage, is maintained through the resonance inductance within the recovery circuit. Then, while the supply voltage is held at ground, the switching state of the output circuit 122 is changed, and after that, the supply voltage to the address drive IC is again raised to the normal constant driving voltage through the resonance, thereby achieving savings in power consumption.

The prior art capacitive-load driving circuit shown in FIG. 2 recovers power by utilizing a phenomenon of resonance, as described above, but with the recent trend toward higher-resolution and larger-screen plasma display panels, the power consumption reduction design has been losing its effectiveness significantly. That is, when the output frequency of the driving circuit is increased to increase the resolution of the panel, it becomes necessary to reduce the resonance time in order to maintain the control performance of the panel. To achieve this, the resonance inductance provided in the power recovery circuit 110 must be reduced in value, and as the Q of the resonance is reduced, the power consumption reducing effect degrades. Furthermore, as the panel screen size increases, parasitic capacitance on address electrodes also increases, and here also, the resonance inductance must be reduced in value in order to suppress an increase in resonance time, as a result of which the power consumption reducing effect degrades.

If the power consumption of the driving circuit cannot be reduced sufficiently, the cost involved in removing heat from various parts of the display, and hence the component cost, increases, and besides, this could lead to a situation where the display brightness is reduced due to the limit of the heat dissipation capability of the display apparatus itself, or where the advantage of the flat panel display, i.e., thin and light-weight construction, cannot be exploited to the full.

Furthermore, as the output frequency of the driving circuit increases, power consumption increases due to the generation of high-voltage pulses to drive the plasma display panel, and temperature rise in the driving circuit (drive IC) becomes a serious concern.

Next, before describing the embodiments of the capacitive-load driving circuit and plasma display apparatus according to the present invention, the principle of the present invention will be described below.

Figure 3:
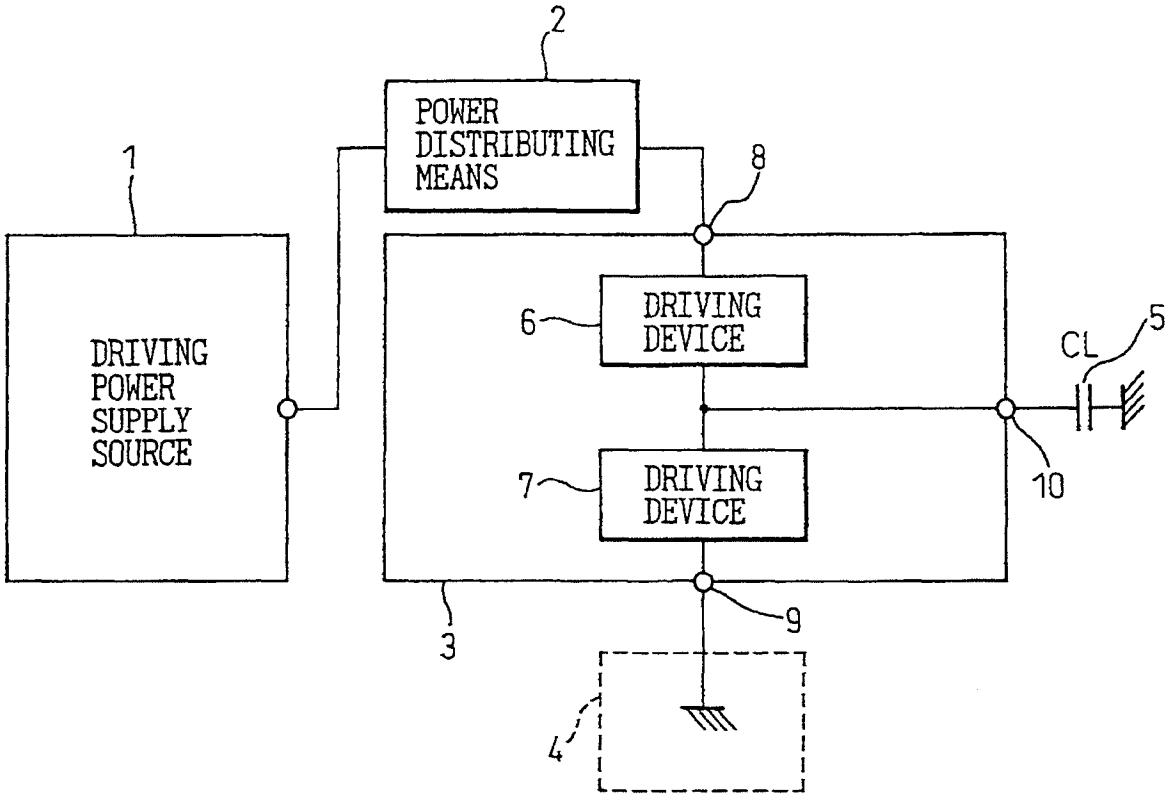
FIG. 3 is a block diagram showing the basic functional configuration of a capacitive-load driving circuit according to the present invention.

FIG. 3 is a block diagram showing the basic functional configuration of the capacitive-load driving circuit of the present invention. In FIG. 3, reference numeral 1 is a driving power supply source, 2 is a power distributing means, 3 is a capacitive-load driving circuit (address drive IC), 4 is a reference potential point (ground point), 5 is a capacitive load (load capacitance), 6 and 7 are driving devices, 8 and 9 are a power supply terminal and a ground terminal (reference potential terminal), respectively, of the address drive IC, and 10 is an output terminal of the address drive IC.

As shown in FIG. 3, the drive current for driving the load capacitor 5 flows from the driving power supply source 1 to the load capacitance 5 through the power distributing means 2 and the driving device 6. The power consumed at this time is distributed in accordance with the ratio of the resistive impedances of the power distributing means 2 and the driving device 6. This power reducing effect does not degrade if the value of the load capacitance 5 or the driving speed (driving frequency) is increased, unlike the case of the prior art power recovery method of FIG. 2 that utilizes a phenomenon of resonance.

In this way, according to the present invention, the power consumed in the address drive IC (capacitive-load driving circuit) can be reduced. That is, though the power consumption as a whole remains the same, a portion of the power that would have been consumed in the address drive IC 3 in the prior art is consumed by the power distributing means 2; this construction serves to simplify the heat sinking structure of the address drive IC 3, and achieves a reduction in circuit cost.

A flat panel display apparatus, in particular, a plasma display apparatus whose trend is toward a larger-screen and higher-resolution display and whose drive voltage is high, requires the use of many large load capacitors and many display panel driving circuits operating at high driving speed; therefore, when the capacitive-load driving circuit of the present invention is applied to such display apparatus, not only can the cost involved in removing heat be reduced significantly, but high-voltage LSIs can be mounted in a very limited space.

The use of the capacitive-load driving circuit of the present invention offers an enormous advantage for a plasma display apparatus in which many capacitive loads (discharge cells, etc.) are driven using high-voltage pulses, but the invention is not specifically limited to the plasma display apparatus, but can be applied extensively to circuits for driving various types of capacitive loads.

The preferred embodiments of the capacitive-load driving circuit and plasma display apparatus according to the present invention will be described in detail below with reference to the accompanying drawings.

Figure 4:
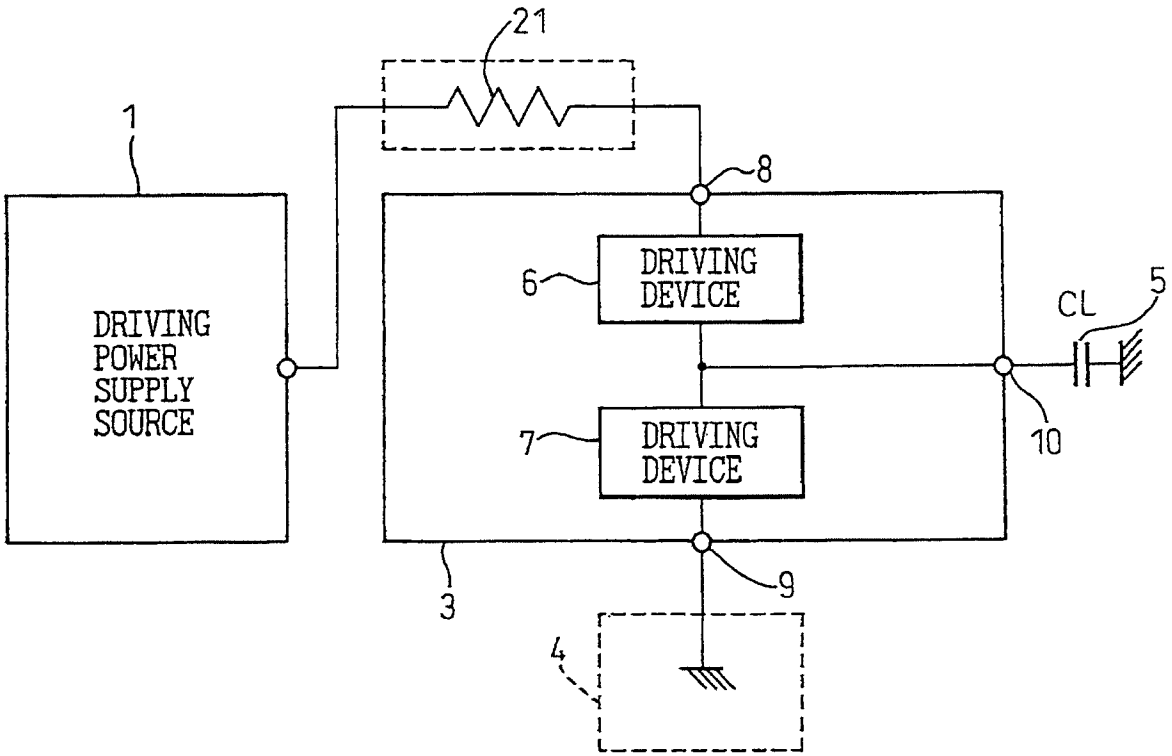
FIG. 4 is a block diagram showing a first embodiment of the capacitive-load driving circuit according to the present invention.

FIG. 4 is a block diagram showing a first embodiment of the capacitive-load driving circuit according to the present invention. In FIG. 4, reference numeral 1 is a driving power supply source, 21 is a power distributing means, 3 is an address drive IC, 4 is a reference potential point (ground point), 5 is a load capacitor, 6 and 7 are driving devices, 8 and 9 are a power supply terminal and a reference potential terminal (ground terminal), respectively, of the address drive IC, and 10 is an output terminal of the address drive IC.

As shown in FIG. 4, in the first embodiment, the power distributing means 21 is inserted between the driving power supply source 1 and the high-level voltage supply terminal 8 of the address drive IC 3; this power distributing means is constructed as a resistive impedance (resistive element) 21 whose value is higher than about one-tenth of the resistive impedance that the driving device 6 provides at the time of conduction (the resistive component of the conducting impedance). According to the first embodiment, the power consumption of the driving circuit 3 can be reduced by distributing to the resistive element 21 about one-tenth or more of the power consumed in the driving device 6 during load driving.

The reason that the impedance of the resistive element (power distributing means) 21 is chosen to be higher than about one-tenth of the resistive impedance that the driving device 6 provides at the time of conduction is that with a lower impedance, the power distributed to the resistive element 21 would be so small that an effective power distribution effect would not be obtained. On the other hand, if the impedance of the resistive element 21 were made too high, the power distribution effect would increase but the driving waveform would deteriorate; therefore, an appropriate upper limit value should be determined according to each individual system (display apparatus, etc.) to which the driving circuit is applied. Accordingly, for the resistive element 21, it is preferable to use a high-power resistor that is inexpensive and reliable, and that has as high a resistance value as possible so that its power consumption can be made larger than the power consumption of the driving device.

Figure 5:
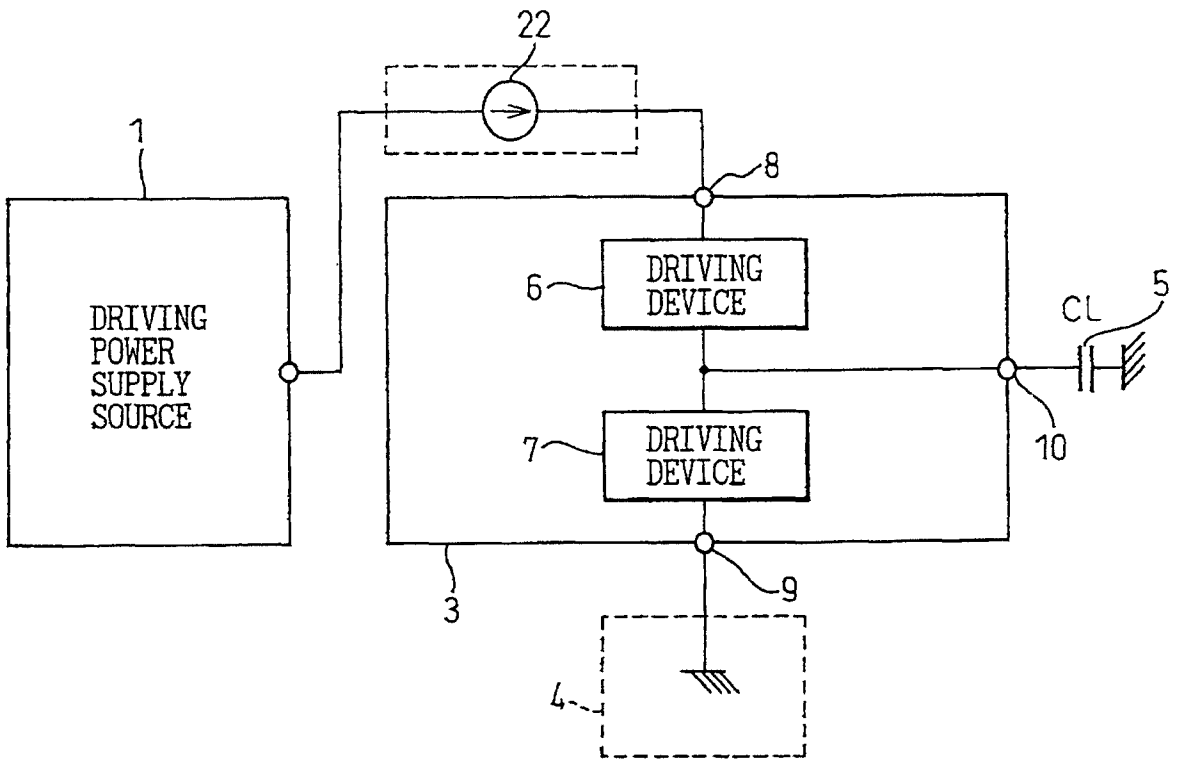
FIG. 5 is a block diagram showing a second embodiment of the capacitive-load driving circuit according to the present invention.

FIG. 5 is a block diagram showing a second embodiment of the capacitive-load driving circuit according to the present invention.

As shown in FIG. 5, in the second embodiment, the power distributing means in the foregoing first embodiment is constructed as a constant-current source 22. With the driving circuit of the second embodiment, the effective value of the current flowing in the driving device 6 can be made the smallest under the same driving conditions; as a result, theoretically, the power consumption of the driving circuit 3 can be reduced to the lowest value.

Figure 6:
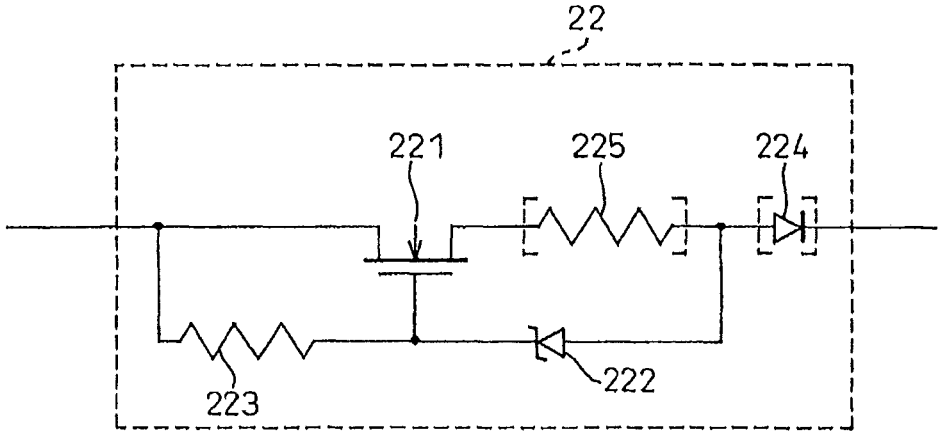
FIG. 6 is a circuit diagram showing an example of a constant-current source in the capacitive-load driving circuit shown in FIG. 5.

FIG. 6 is a circuit diagram showing one example of the constant-current source in the capacitive-load driving circuit shown in FIG. 5.

As shown in FIG. 6, the constant-current source 22 comprises an n-channel MOS transistor (nMOS transistor) 226 whose gate-to-source voltage is biased, for example, to a constant voltage by a Zener diode 227. As shown, a resistor 225 may be connected in series to the source of the transistor 226 to compensate for the degradation of current accuracy due to device variations existing in the transistor 226. Further, a resistive element 223 is connected between the gate and drain of the transistor 221 to bias the Zener diode 227. In this embodiment, power is distributed (consumed) by the constant-current source 22 (transistor 226) and heat is generated; in practice, the constant-current source 22 is constructed in IC form and mounted to a heat sink, or the transistor 226 as a discrete component is mounted to a heat sink. The constant-current source 22 may be constructed from a single MOS transistor whose gate and source are connected together.

Here, in an application, for example, where power is supplied to a plurality of driving circuits 3 (driving devices 6) via a plurality of constant-current sources 22 by using one driving power supply source 1 shown in FIG. 5, a diode 224 may be inserted in series to each constant-current source 22 in order to avoid interference between the respective driving circuits 3. Further, as will be described later, in an application where the voltage of the driving power supply source 1 is switched between different levels, current distributing means can be constructed by connecting the constant-current source circuits 22 in parallel so that current flows in opposite directions in the respective constant-current source circuits 22 to each of which the diode 224 is inserted in series.

Figure 7:
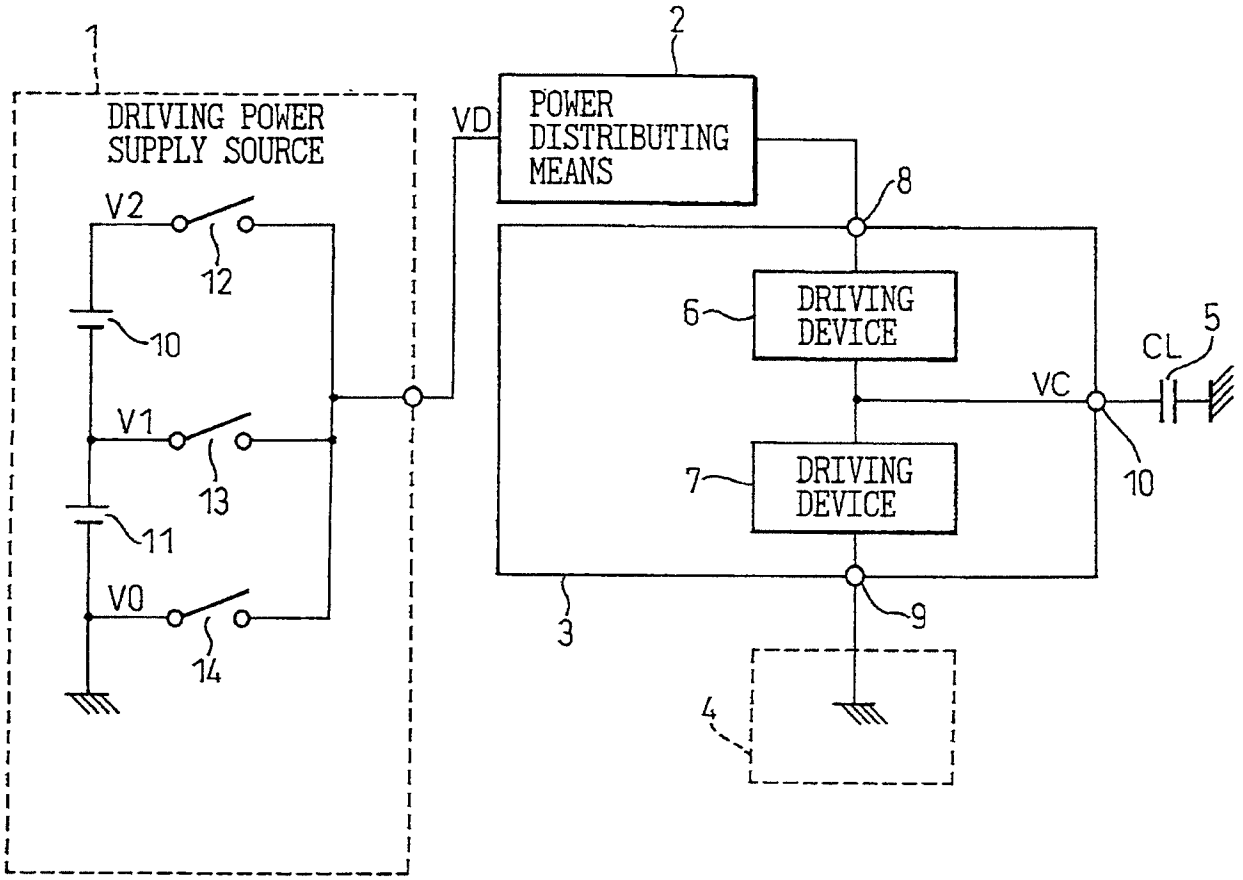
FIG. 7 is a block diagram showing a third embodiment of the capacitive-load driving circuit according to the present invention.
Figure 8:
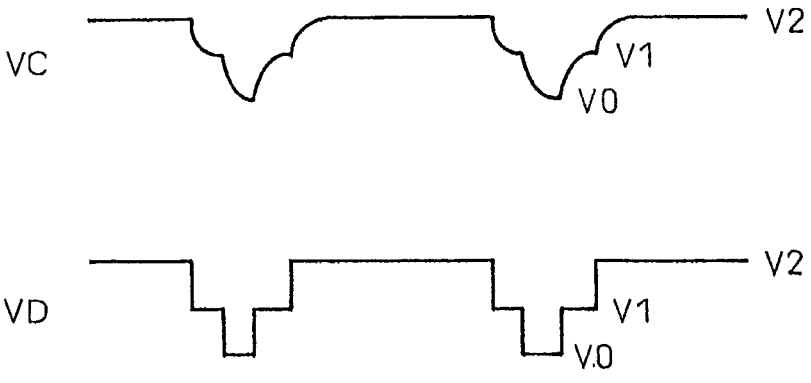
FIG. 8 is a diagram for explaining the operation of a driving power supply source in the third embodiment shown in FIG. 7.

FIG. 7 is a block diagram showing a third embodiment of the capacitive-load driving circuit according to the present invention, and FIG. 8 is a diagram for explaining the operation of the driving power supply source in the third embodiment shown in FIG. 7. The feature of the third embodiment lies in the configuration of the driving power supply source 1, and the configuration of the remaining section (the address drive IC 3 and the power distributing means 2) is the same as that of the driving circuit previously described with reference to FIG. 3.

As shown in FIG. 7, the driving power supply source 1 comprises voltage sources 10 and 11 and switches 12 to 14, and the voltage applied to the power supply terminal 8 of the address drive IC 3 via the power distributing means 2 is changed by selecting (turning on) one of the switches 12 to 14.

The driving power supply source 1 outputs a high-level supply voltage V2 when the switch 12 is on, an intermediate voltage V1 when the switch 13 is on, and a ground potential V0 when the switch 14 is on. As shown in FIG. 8, while retaining the on/off state of the driving device 6, the driving power supply source 1 raises or lowers its output voltage VD in steps by switching the output voltage VD between a plurality of voltage values (V0, V1, and V2) within the voltage amplitude of the drive voltage VC used to drive the capacitive load (CL) 5. This serves to reduce the amplitude of the drive current and hence the effective value of the current, thereby reducing the power consumption of the entire driving circuit system including the driving power supply source 1. The voltages to be selected by the switches in the driving power supply source 1 are not limited to the high-level supply voltage V2, low-level supply voltage V0, and intermediate-level supply voltage V1; for example, the section between the high-level supply voltage V2 and the low-level supply voltage V0 may be divided into M equal sections, and the output voltage VD may be controlled using M+1 switches. In this case, the power consumption of the entire driving circuit system can be reduced down to 1/M. Furthermore, when a bidirectional device, such as a MOSFET with a diode parasitic between its output terminals, is used as the driving device 6, all the power consumption associated with the charging and discharging of the load capacitor 5 can be distributed to the power distributing means 2. In this case, the power consumption in the driving device 7 is negligibly small.

Figure 9:
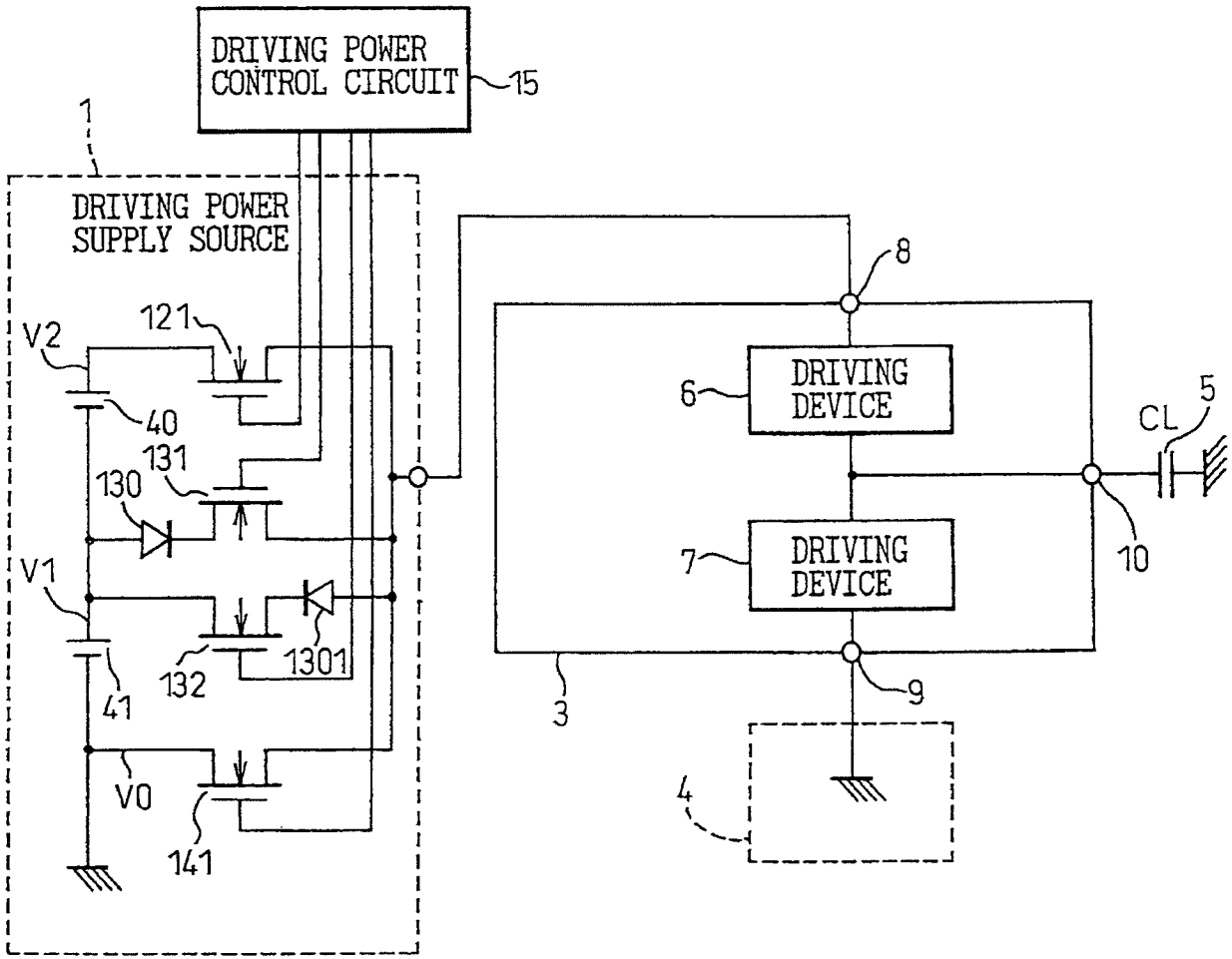
FIG. 9 is a block diagram showing a fourth embodiment of the capacitive-load driving circuit according to the present invention.

FIG. 9 is a block diagram showing a fourth embodiment of the capacitive-load driving circuit according to the present invention.

In the fourth embodiment, the switches 12, 13, and 14 in the driving power supply source 1 of FIG. 7 described above are replaced by nMOS transistors 121, 131/132, and 141, respectively, whose gate voltages are controlled by a driving power control circuit 15, thus making the driving power supply source 1 also perform the function of the power distributing means using the constant-current sources as in the second embodiment shown in FIG. 5. In the fourth embodiment, diodes 130 and 1301 are connected in series to the drains of the transistors 131 and 132 but, instead, these diodes may be inserted in series to the sources of the transistors 131 and 132. Further, in FIG. 9, the switches in the driving power supply source 1 are constructed from nMOS transistors, but it will be appreciated that use can also be made of other active devices such as pMOS transistors or bipolar transistors.

In this way, in the fourth embodiment, nMOS transistors (active devices) are used as the switches (voltage switching means) in the driving power supply source circuit 1, and the control terminals (gates) of the active devices are constant-voltage or constant-current controlled, thereby regulating the output of each active device at a constant current level. In this way, the power consumption of the entire driving circuit system including the driving circuit 3 can be reduced sufficiently, and at the same time, the number of devices used can also be reduced.

Figure 10:
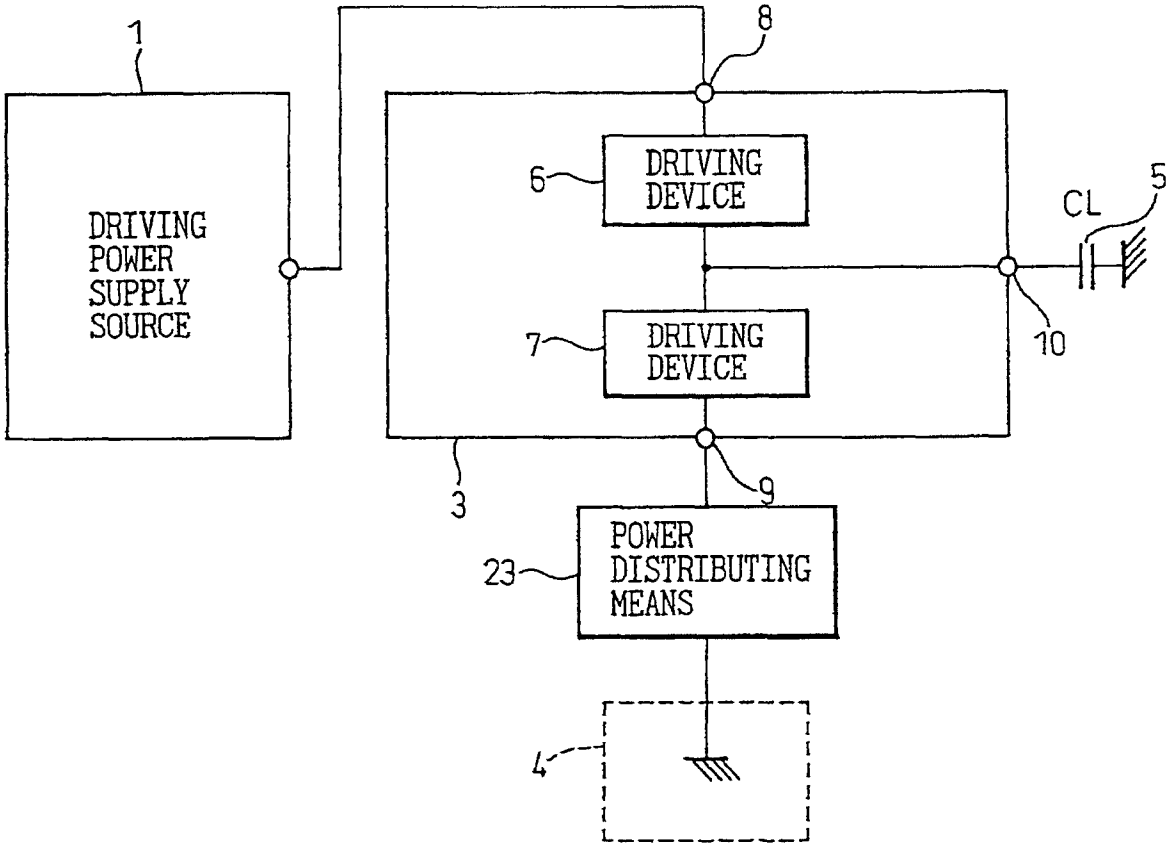
FIG. 10 is a block diagram showing a fifth embodiment of the capacitive-load driving circuit according to the present invention.

FIG. 10 is a block diagram showing a fifth embodiment of the capacitive-load driving circuit according to the present invention.

As shown in FIG. 10, in the fifth embodiment, the power distributing means 23 is inserted between the reference potential point (ground point) 4 and the low-level voltage supply terminal 9 of the address drive IC (driving circuit) 3.

When driving the voltage of the load capacitor 5 to the potential of the reference potential point (for example, ground point) 4, if the power distributing means 23 is inserted in series to the driving device 7 connected between the load capacitor 5 and the reference potential point 4 as illustrated here, the power consumption of the driving device 7 can be reduced by distributing a portion of the power to the power distributing means 23. That is, by distributing a portion of the power consumed in the address drive IC (capacitive-load driving circuit) 3 to the power distributing means 23 for consumption therein, the heat sinking structure of the driving circuit 3 can be simplified and the circuit cost reduced.

Figure 11:
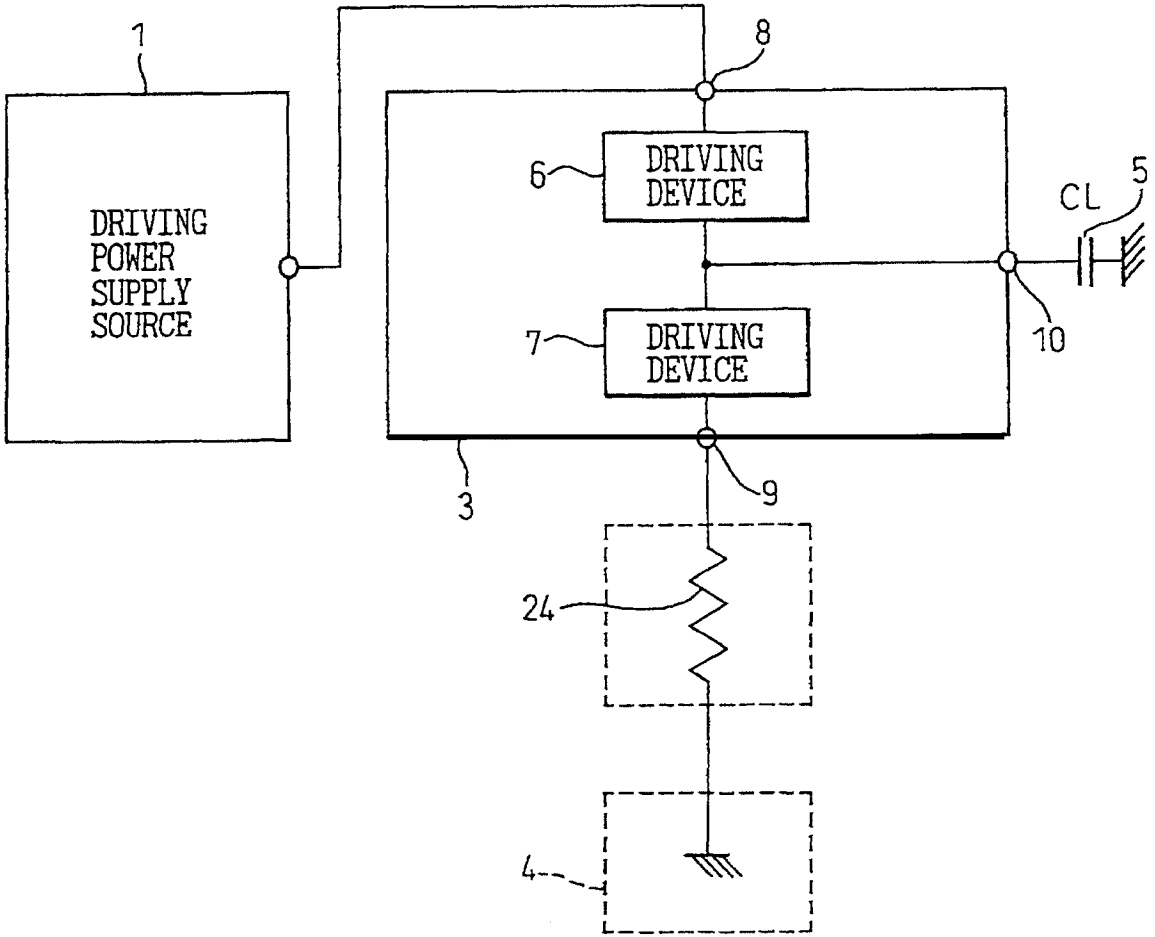
FIG. 11 is a block diagram showing a sixth embodiment of the capacitive-load driving circuit according to the present invention.

FIG. 11 is a block diagram showing a sixth embodiment of the capacitive-load driving circuit according to the present invention.

In the sixth embodiment, the power distributing means 23 in the fifth embodiment is constructed as a resistive element (resistive impedance) 24, as in the previously described first embodiment. Here, the impedance of the resistive element 24 is chosen to be higher than about one-tenth of the resistive impedance that the driving device 7 provides at the time of conduction; as a result, about one-tenth or more of the power consumption in the driving device 7 during load driving is distributed to the resistive element 24, thereby reducing the power consumption of the driving circuit 3.

Figure 12:
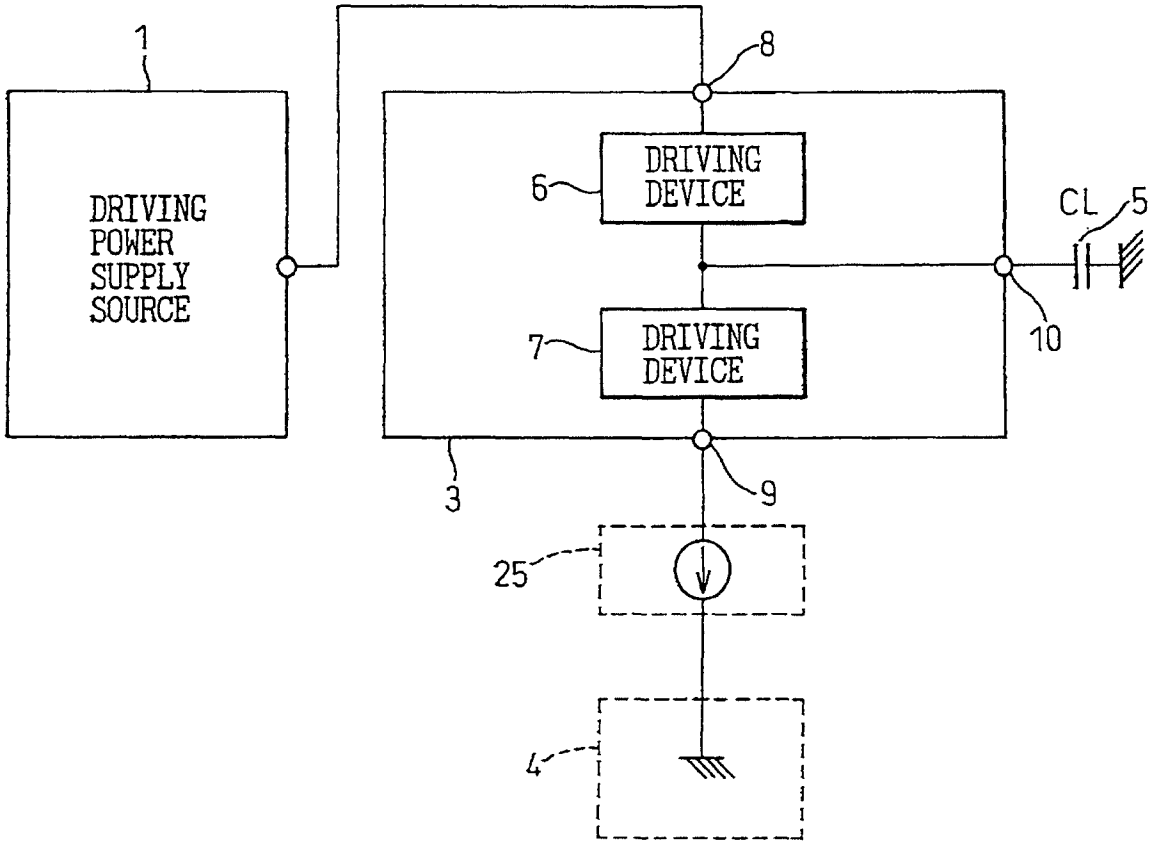
FIG. 12 is a block diagram showing a seventh embodiment of the capacitive-load driving circuit according to the present invention.

FIG. 12 is a block diagram showing a seventh embodiment of the capacitive-load driving circuit according to the present invention.

In the seventh embodiment, the power distributing means 23 in the fifth embodiment is constructed as a constant-current source 25, as in the previously described second embodiment. By constructing the power distributing means from the constant-current source 25 as illustrated here, the effective value of the current flowing in the driving device 7 can be made the smallest under the same driving conditions; as a result, theoretically, the seventh embodiment can achieve lower power consumption than any other driving method that uses a driving device.

Figure 13:
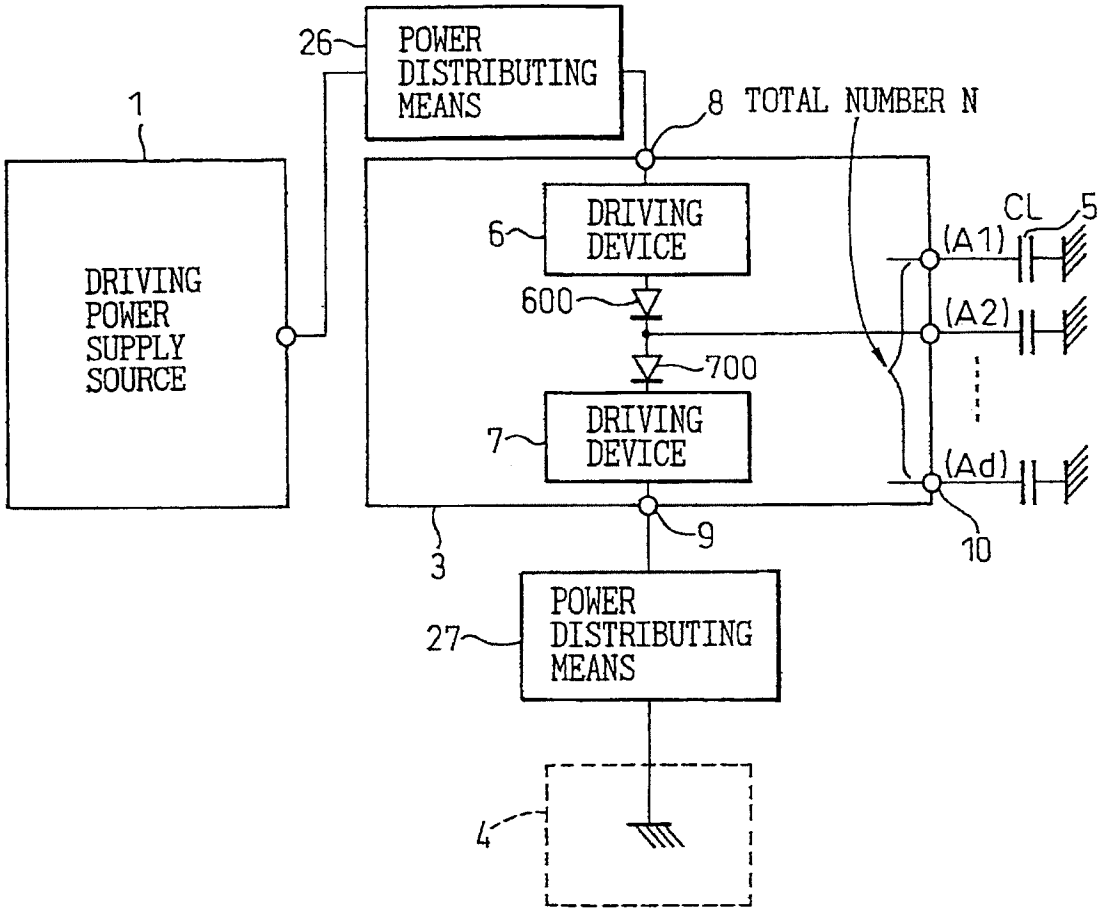
FIG. 13 is a block diagram showing an eighth embodiment of the capacitive-load driving circuit according to the present invention.

FIG. 13 is a block diagram showing an eighth embodiment of the capacitive-load driving circuit according to the present invention.

In the eighth embodiment, a first power distributing means 26 is provided between the driving power supply source 1 and the high-level voltage supply terminal 8 of the driving circuit 3, and a second power distributing means 27 is provided between the reference potential point and the low-level voltage supply terminal 9 of the driving circuit 3; further, diodes 60 and 70 are inserted between the driving device 6 and a driving terminal 10 and between the driving terminal 10 and the driving device 7, respectively.

In an application where a plurality of load capacitors CL (5) are driven using the driving circuit 3 (when constructed in integrated circuit form), the power consumption of the driving circuit 3 can be reduced sufficiently by inserting the diode 60 or 70 in series with at least either one of the driving devices 6 and 7. That is, by eliminating unnecessary output voltage variations using the series-connected diode 60 or 70, it becomes possible to suppress an excess drive current flowing into the load capacitor due to the interference occurring between the outputs via a common power supply line or a reference potential line connected to the ground, and thus the power consumption of the driving circuit 3 can be reduced. Furthermore, since unnecessary drive voltage can be prevented from being applied to the driving devices in the plasma display apparatus, not only does the display quality improve, but the drive voltage can also be reduced while reducing the drive voltage margin.

In an application where a plurality of load capacitors are driven using the driving circuit 3, when the power distributing means 26 and 27 are each constructed using a resistive impedance (resistive element), each resistive element should be chosen to have a resistive impedance higher than about one-tenth of the conducting resistive impedance of the driving device 6 or 7 divided by the number of output terminals (for example, address lines A1 to Ad: d=N); by so doing, the power consumption of the driving circuit 3 can be reduced by distributing about one-tenth or more of the power consumed in the driving devices 6 and 7 during load driving to the respective resistive elements.

Here, when the configuration of the driving circuit 3 is applied to the address driving circuit (102 in FIG. 1) in the plasma display apparatus, 384 lines (N=384) are driven using one driving circuit (address drive IC) 3. At this time, assuming that the ON resistance of the driving device 6 (7) is 200Ω, for example, the impedance of the power distributing means 26 (27) is set higher than about one-tenth of 200÷384·=· 0.5 [Ω], that is, higher than about 0.05Ω. With this configuration, about one-tenth or more of the power that would otherwise be consumed by the address drive IC 3 alone is distributed to the power distributing means 26 (27), thereby reducing a temperature rise in the address drive IC 3.

Figure 14:
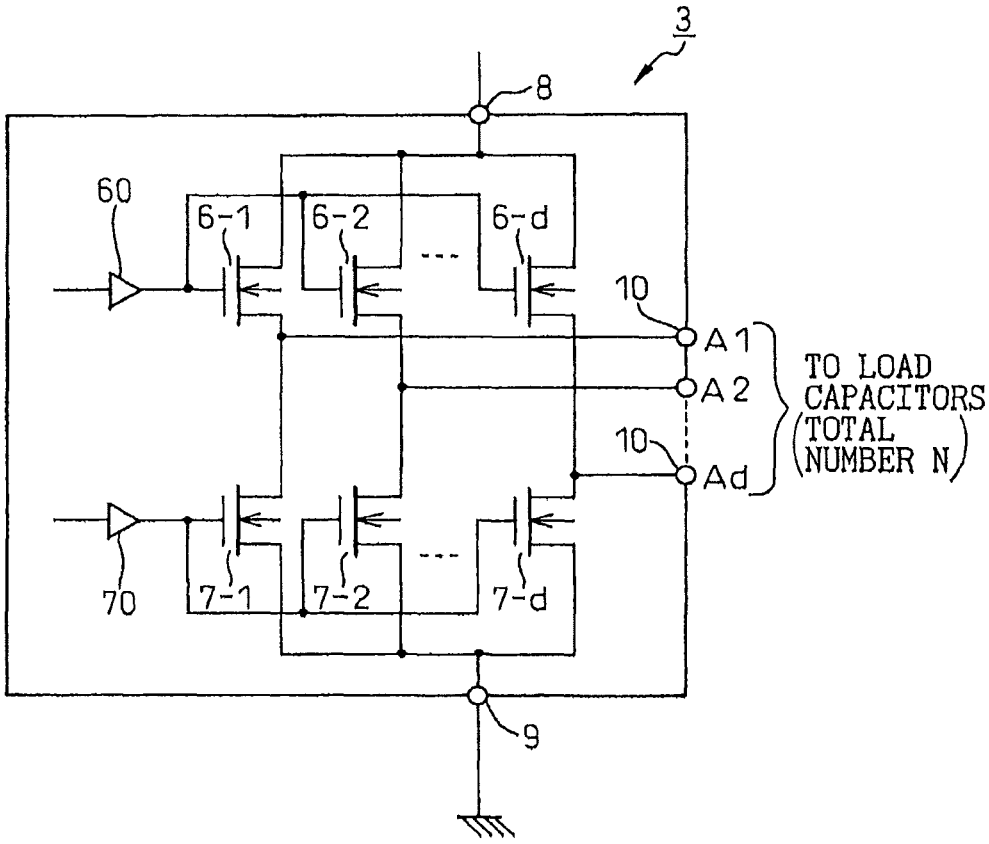
FIG. 14 is a circuit diagram of a totem-pole type address drive IC as a ninth embodiment of the capacitive-load driving circuit according to the present invention.

FIG. 14 is a circuit diagram of a totem-pole type address drive IC as a ninth embodiment of the capacitive-load driving circuit according to the present invention.

As shown in FIG. 14, the ninth embodiment concerns an address drive IC 3 for driving, for example, the number, d, of address electrodes (A1 to Ad) in a plasma display apparatus, and employs a totem-pole configuration using nMOS transistors for both pullup-side driving devices 6-1 to **6-*d* and pulldown-side driving devices 7-1 to 7-*d*. The pullup- and pulldown-side driving devices are driven from the drive stages 60 and 70**, respectively.

When the driving circuit 3 is constructed using the totem-pole configuration as described above, the driving circuit (IC) can be constructed at low cost since the chip area can be reduced by using only nMOS transistors having a higher current-handling capability than pMOS transistors.

Figure 15:
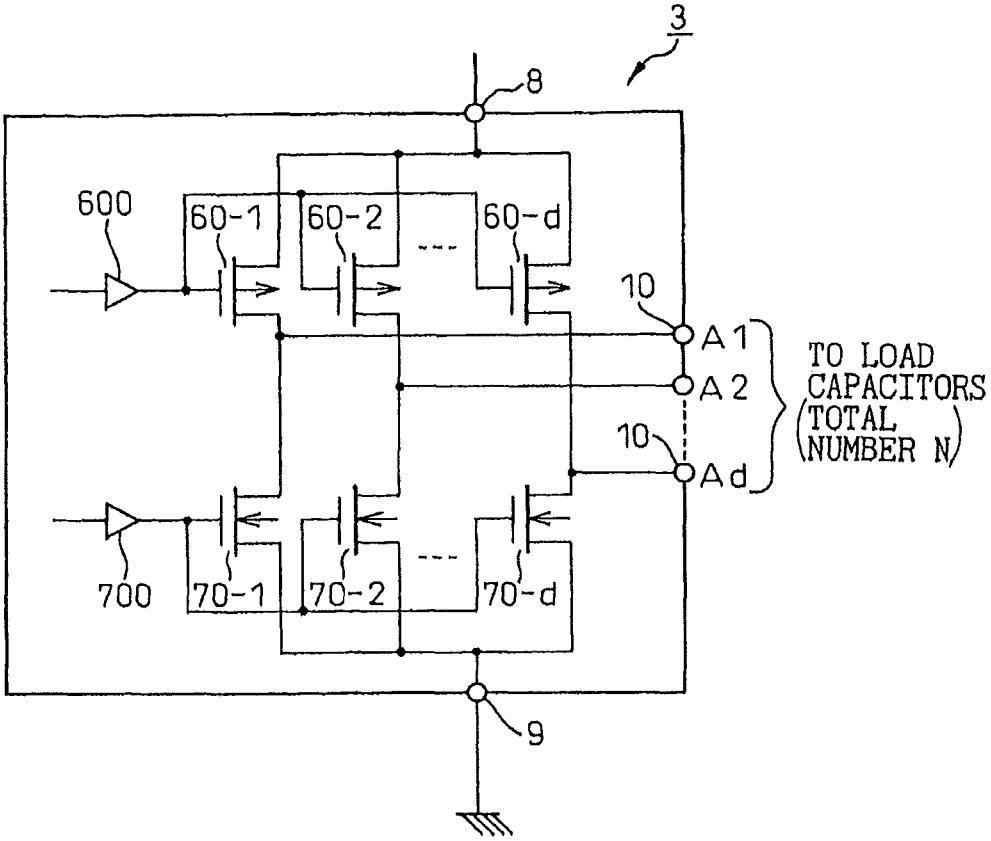
FIG. 15 is a circuit diagram of a CMOS-type address drive IC as a 10th embodiment of the capacitive-load driving circuit according to the present invention.

FIG. 15 is a circuit diagram of a CMOS-type address drive IC as a 10th embodiment of the capacitive-load driving circuit according to the present invention.

As shown in FIG. 15, the 10th embodiment concerns an address drive IC 3 for driving, for example, the number, d, of address electrodes (A1 to Ad) in a plasma display apparatus, and employs a CMOS configuration using pMOS transistors for pullup-side driving devices 60-1 to **60-*d* and nMOS transistors for pulldown-side driving devices 70-1 to 70-*d*. The pullup- and pulldown-side driving devices are driven from the drive stages 600 and 700**, respectively.

By constructing the driving circuit 3 using the CMOS configuration as described above, the drive power for the pullup-side driving devices can also be reduced, and the rise and fall times of the drive voltage can be reduced while retaining good symmetry between them.

Figure 16:
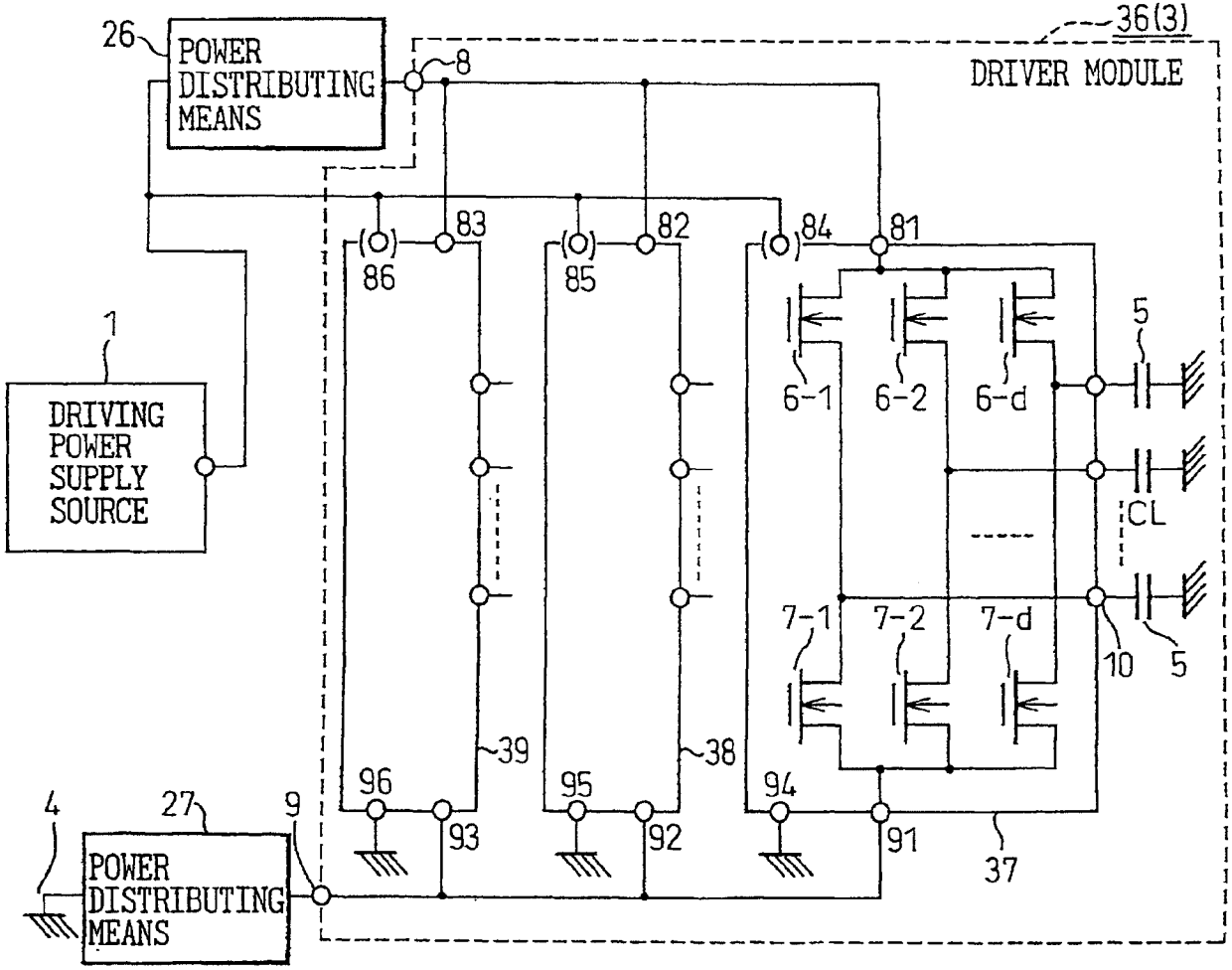
FIG. 16 is a block diagram showing an 11th embodiment of the capacitive-load driving circuit according to the present invention.

FIG. 16 is a block diagram showing an 11th embodiment of the capacitive-load driving circuit according to the present invention.

The 11th embodiment, as in the eighth embodiment, drives a plurality of load capacitors 5 from one driving circuit (drive IC). The driving circuit is constructed at low cost using conventional driver ICs; a driver module 36 (driving circuit 3) specifically designed to drive multi-terminal capacitive loads, such as those in a plasma display panel, comprises three integrated circuits (driver ICs) 37, 38, and 39. The integrated circuits 37, 38, and 39 are identical in configuration; the totem-pole configuration such as shown in FIG. 14 is employed here, but the CMOS configuration may be employed instead. The integrated circuits 37, 38, and 39 receive the output voltage of the driving power supply source 1 directly at the power supply terminals 84, 85, and 86 of the output front stages of the respective ICs, and also receive it at the power supply terminals 81, 82, and 83(8) of the respective high-voltage output devices via the power distributing means 26. Further, the integrated circuits 37, 38, and 39 receive the voltage of the reference potential point 4 directly at the power supply terminals 94, 95, and 96, and also receive it at the power supply terminals 91, 92, and 93(9) via the power distributing means 27. However, the power supply terminals 84, 85, and 86 may be omitted, and the power supply terminals 81, 82, and 83(8) of the high-voltage output devices may be substituted for them, as will be described later with reference to FIG. 17.

In this way, in the 11th embodiment, by connecting the power supply terminal 8 of the driver module 36 to the driving power supply source 1 via the power distributing means 26, the power consumption of the driving devices 6-1 to **6-*d*, etc. within the module is distributed to the power distributing means 26 outside the module and, by connecting the power supply terminal 9 of the driver module 36 to the ground potential point 4 via the power distributing means 27, the power consumption of the driving devices 7-1 to 7-*d*, etc. within the module is distributed to the power distributing means 27 outside the module. With this configuration, a temperature rise in the driver module 36** is reduced and the reliability increased, making it possible to reduce the cost involved in removing the generated heat and thus reduce the cost of the driver module (capacitive-load driving circuit).

The reason that the power supply terminals 84, 85, and 86 of the integrated circuits 36, 37, and 38 are connected to the output of the driving power supply source 1 and the power supply terminals 94, 95, and 96 to the ground potential point 4 is to control the high-voltage output devices 6-1 to **6-*d* at high speed in the respective integrated circuits 36, 37, and 38, and to ensure stable application of signal voltages to many logic signal input terminals with respect to ground by connecting the ground terminals for the low-voltage circuits, such as logic circuits, in the respective integrated circuits 36, 37, and 38 directly to the reference potential point (ground terminal) 4**.

Figure 17:
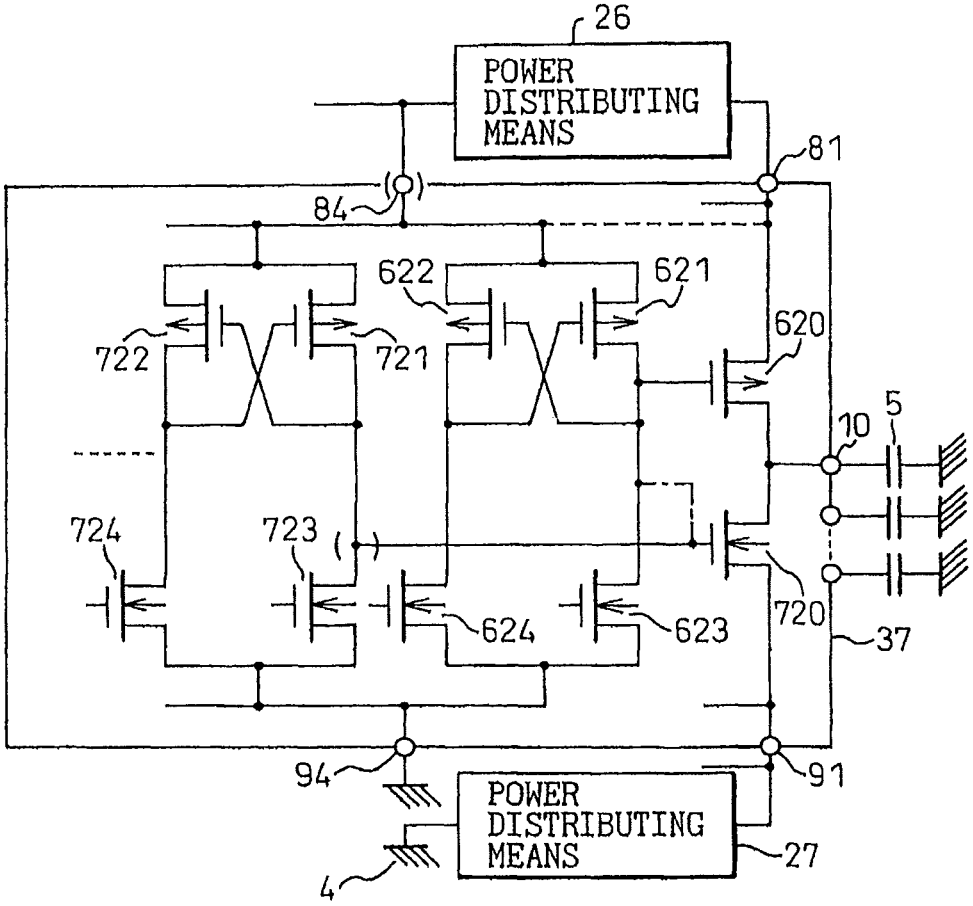
FIG. 17 is a block circuit diagram showing an example of an integrated circuit forming a driver module as a 12th embodiment of the capacitive-load driving circuit according to the present invention.

FIG. 17 is a block circuit diagram showing one example of an integrated circuit forming a driver module as a 12th embodiment of the capacitive-load driving circuit according to the present invention.

As shown in FIG. 17, the 12th embodiment shows one example of the integrated circuit 37 (38, 39) in the driver module 36 (3) shown in FIG. 16.

As earlier described, the integrated circuit 37 can be constructed as a totem-pole circuit, but in the 12th embodiment, the input withstand voltage is increased up to the voltage value of the driving power supply source, for example, by increasing the gate film thicknesses of the output devices 620 and 720 forming the CMOS output circuit. These high-voltage (high voltage withstanding) output devices 620 and 720, whose control inputs (gates) are controlled by their preceding flip-flop circuits constructed from transistors 612 to 624 and 721 to 724, respectively, are driven to a full-swing level either at the drive supply voltage or at the reference voltage (ground potential). With this configuration, the high-voltage output devices 620 and 720 can be controlled in a stable manner even when the potentials at the high-level voltage supply terminal 81 and the high-voltage device reference potential terminal (ground terminal) 91 are varied greatly in order to enhance the power consumption distributing effect of the power distributing means 26 and 27.

Devices having a high input withstand voltage are used as the transistors 620, 621, 622, 721, and 722 in FIG. 17 because they are driven to a full-swing level. Further, the power supply terminal 84 for the circuit preceding the drive circuit in the front stage of the high-voltage output devices 620 and 720 may be omitted, and the power supply line of the front-stage circuit may be extended, as shown by the dashed line in FIG. 17, and shared with the high-voltage output devices, to reduce the number of terminals of the integrated circuit 37. If the drive mode for turning both output devices 620 and 720 off is not necessary, the flip-flop circuit constructed from the transistors 721 to 724 at the front stage can be omitted. In that case, the control input terminal (gate) of the output device 720 should be disconnected from the drain terminal of the transistor 723 and connected instead to the drain terminal of the transistor 623.

Figure 18:
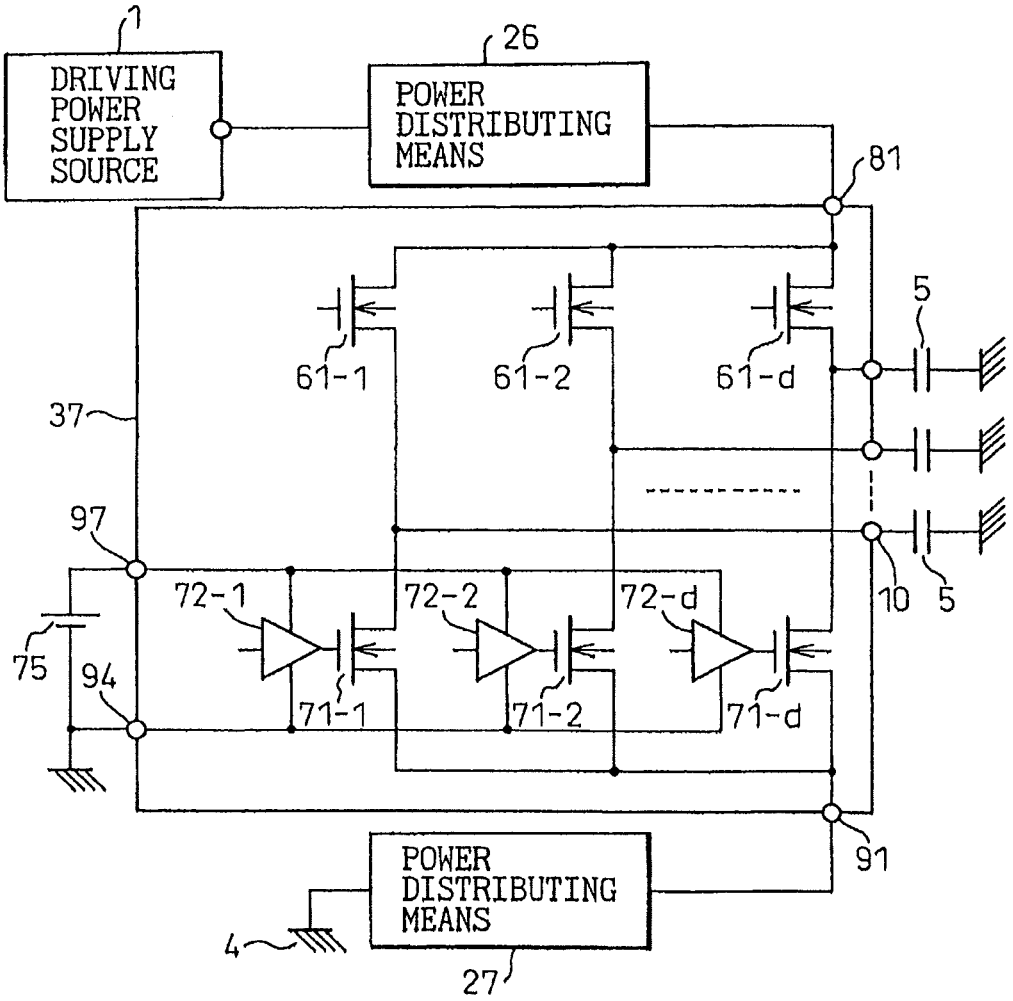
FIG. 18 is a block circuit diagram showing another example of an integrated circuit forming a driver module according to a 13th embodiment of the capacitive-load driving circuit according to the present invention.

FIG. 18 is a block circuit diagram showing another example of an integrated circuit forming a driver module according to a 13th embodiment of the capacitive-load driving circuit according to the present invention.

In the integrated circuit 37 of the 13th embodiment, inexpensive devices (transistors) with a low input withstand voltage, and that can be controlled sufficiently by a logic power supply 75, are used as the high-voltage output devices 71-1 to **71-*d*. More specifically, the integrated circuit 37 has a ground terminal 94 and a logic power supply terminal 97 for receiving the output of the logic power supply 75, and self-biasing is applied to the nMOS transistors 71-1 to 71-*d* by the logic voltage outputs of the buffers 72-1 to 72-*d* and the voltage drop occurring across the power distributing means 27. The transistors 61-1 to 61-*d*** are not limited to nMOS transistors, but it will be appreciated that they may be constructed from pMOS transistors or bipolar transistors.

Figure 19:
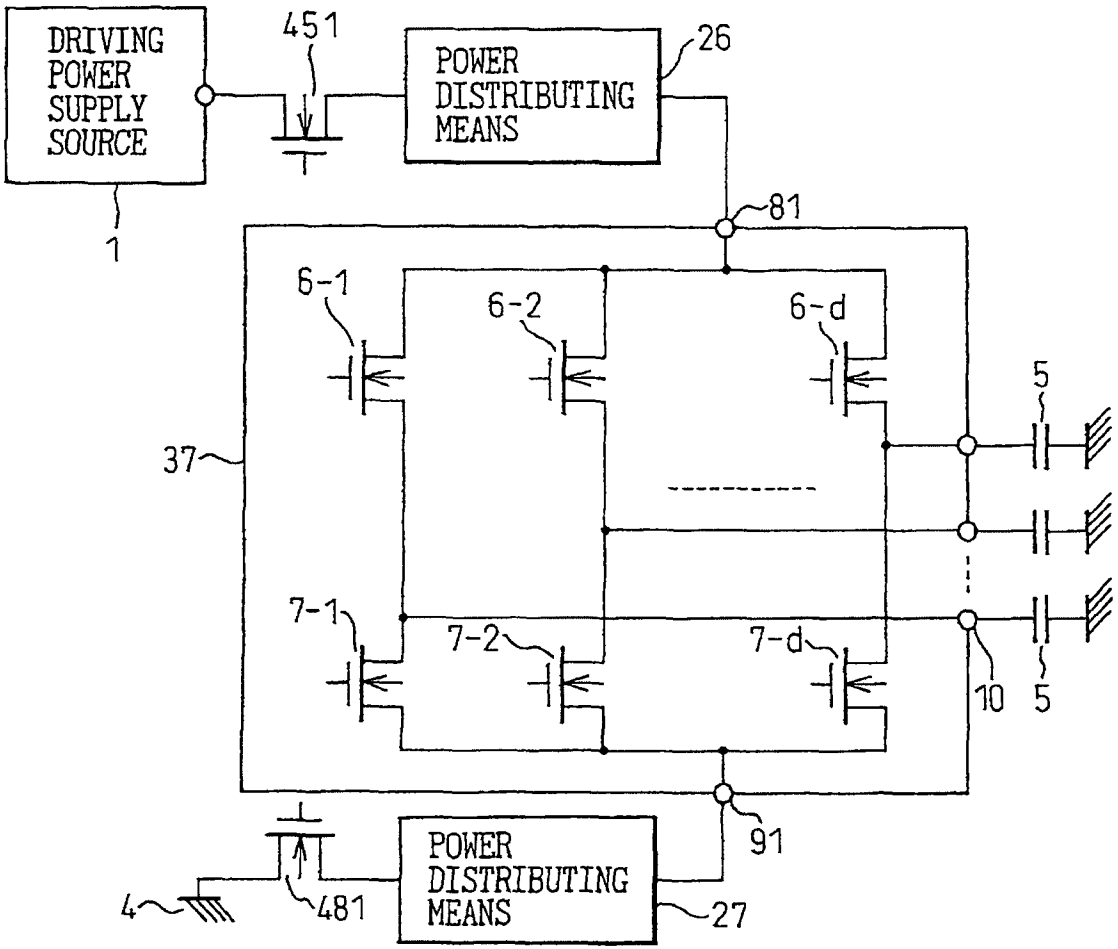
FIG. 19 is a block circuit diagram showing still another example of an integrated circuit forming a driver module according to a 14th embodiment of the capacitive-load driving circuit according to the present invention.

FIG. 19 is a block circuit diagram showing still another example of an integrated circuit forming a driver module according to a 14th embodiment of the capacitive-load driving circuit according to the present invention.

Compared with the integrated circuit 37 of the 11th embodiment shown in FIG. 16, the integrated circuit 37 of the 13th embodiment further increases the power distribution efficiency and reduces the power consumption of the driving devices by providing at least a switch device 451 between the driving power supply source 1 and the power distributing means 26 or a switch device 481 between the reference potential point 4 and the power distributing means 27. That is, after the driving devices 6-1 to **6-*d* and 7-1 to 7-*d* have been completely switched into a conducting state, the switch devices 451 and 481 are caused to conduct, thereby avoiding degradation of the power distributing effect when impedance is not lowered after starting the driving devices to conduct. Furthermore, in the 14th embodiment, the switch devices 451 and 481** also act to effectively distribute power.

As described above, according to the embodiments of the present invention, there is achieved a capacitive-load driving circuit, in particular, a driving circuit for a plasma display apparatus, in which the power consumption of the driving circuit itself is reduced by distributing the power consumption associated with the capacitive component of the load to the power distributing means. The invention can thus alleviate the temperature-rise problem occurring, for example, in a 40-inch or larger plasma display apparatus having large load capacitance, a high-resolution plasma display apparatus having a high drive pulse rate, such as SVGA (800×600 dots), XGA (1024×768 dots), or even SXGA (1280×1024), or a high-brightness high-grayscale plasma display apparatus for TV or HDTV, and can promote a compact and low-power design for such display apparatuses. This also serves to suppress the increase in power consumption that occurs when the drive pulse rate is increased to cope with false contours in moving images.

Figure 20:
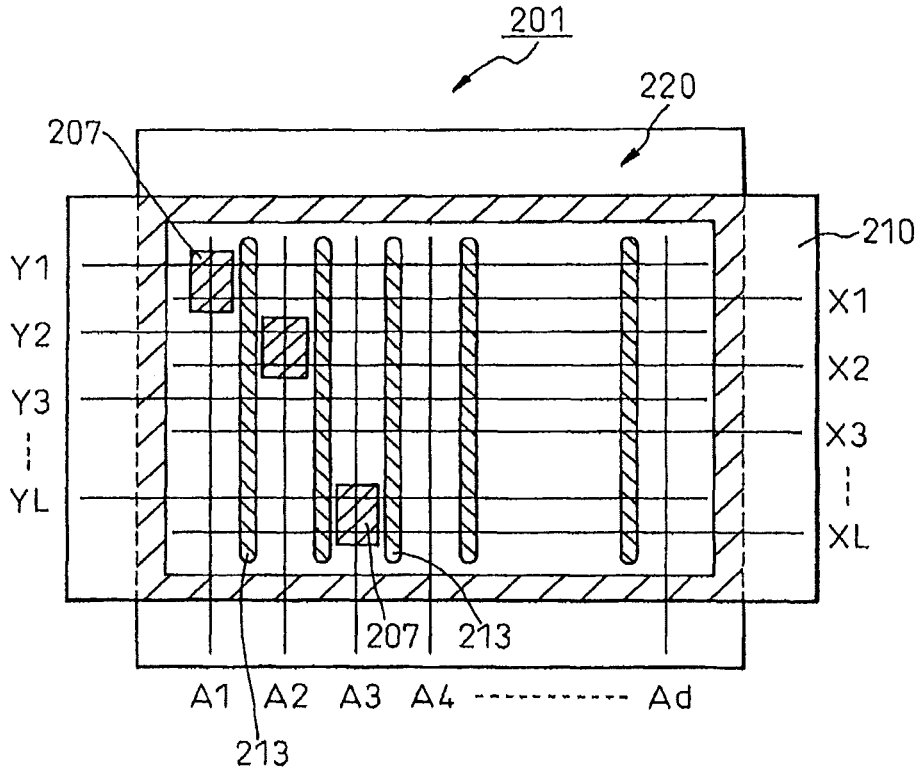
FIG. 20 is a block diagram schematically showing a three-electrode surface-discharge AC plasma display panel.
Figure 21:
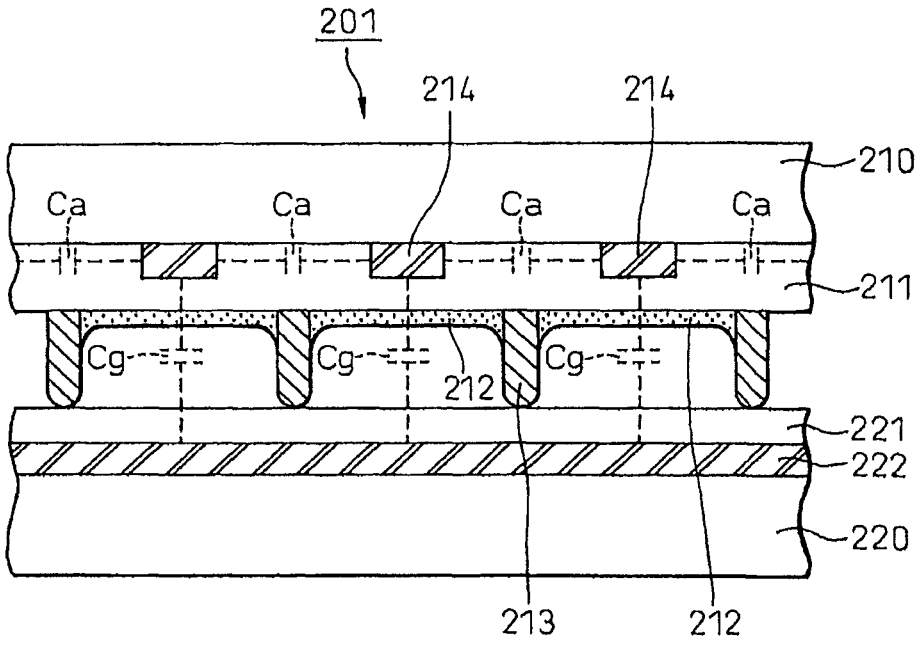
FIG. 21 is a cross-sectional view for explaining the electrode structure in the plasma display panel shown in FIG. 20.

FIG. 20 is a block diagram schematically showing a three-electrode surface-discharge AC plasma display panel, and FIG. 21 is a cross-sectional view for explaining the electrode structure in the plasma display panel shown in FIG. 20. In FIGS. 20 and 21, reference numeral 207 is a discharge cell (display cell), 210 is a back glass substrate, 211 and 221 are dielectric layers, 212 is a phosphor, 213 is a barrier wall, 214 is an address electrode (A1-Ad), 220 is a front glass substrate, and 222 is an X electrode (X1-XL) or Y electrode (Y1-YL). Reference numeral Ca indicates capacitance between adjacent address electrodes, and Cg denotes capacitance between counter electrodes (X and Y electrodes) for an address electrode.

The plasma display panel 201 comprises two glass substrates, the back glass substrate 210 and the front glass substrate 220, and on the front glass substrate 220 are formed the X electrodes (X1, X2, . . . , XL) and Y electrodes (scanning electrodes Y1, Y2, . . . , YL) composed of transparent electrodes and bus electrodes as sustain electrodes.

On the back glass substrate 210 are formed the address electrodes (A1, A2, . . . , Ad) in such a manner as to intersect at right angles to the sustain electrodes (X electrodes and Y electrodes) 222, and each display cell 207, which produces light by an electrical discharge between electrodes, is formed in a region flanked by the sustain electrodes with the same number (Y1 and X1, Y2 and X2, etc.) and located where the sustain electrodes intersect the address electrode.

Figure 22:
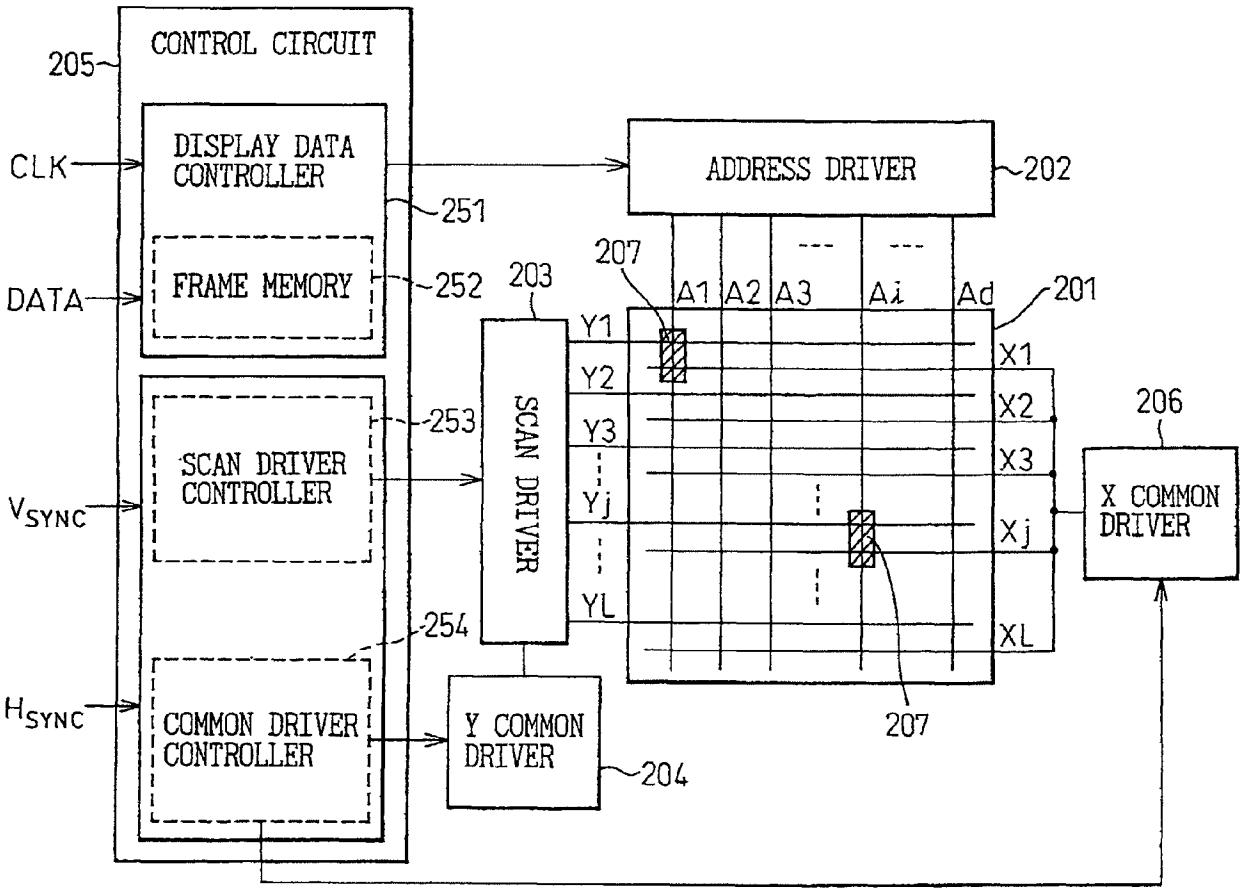
FIG. 22 is a block diagram showing the entire configuration of a plasma display apparatus using the plasma display panel shown in FIG. 20.

FIG. 22 is a block diagram showing the entire configuration of the plasma display apparatus using the plasma display panel shown in FIG. 20; essential parts of the driving circuits for the display panel are shown here.

As shown in FIG. 22, the three-electrode surface-discharge AC plasma display apparatus comprises: a display panel 201; a control circuit 205 for creating, from externally applied interface signals, control signals for controlling the display panel driving circuits; and the driving circuits consisting of an X common driver (X-electrode driving circuit) 206, scanning electrode driving circuit (scan driver) 203, Y common driver 204, and address electrode driving circuit (address driver) 202 for driving the panel electrodes in accordance with the control signals supplied from the control circuit 205.

The X common driver 206 generates a sustain voltage pulse, the Y common driver 204 also generates a sustain voltage pulse, and the scan driver 203 drives the scanning electrodes (Y1 to YL) independently of each other by scanning from one electrode to the next. The address driver 202 applies an address voltage pulse to each address electrode (A1 to Ad) in accordance with display data.

The control circuit 205 contains a display data controller 251 which receives a clock CLK and display data DATA and supplies an address control signal to the address driver 202, a scan driver controller 253 which receives a vertical synchronization signal Vsync and horizontal synchronization signal Hsync and controls the scan driver, and a common driver controller 254 which controls the common drivers (X common driver 206 and Y common driver 204). The display data controller 251 includes a frame memory 252.

Figure 23:
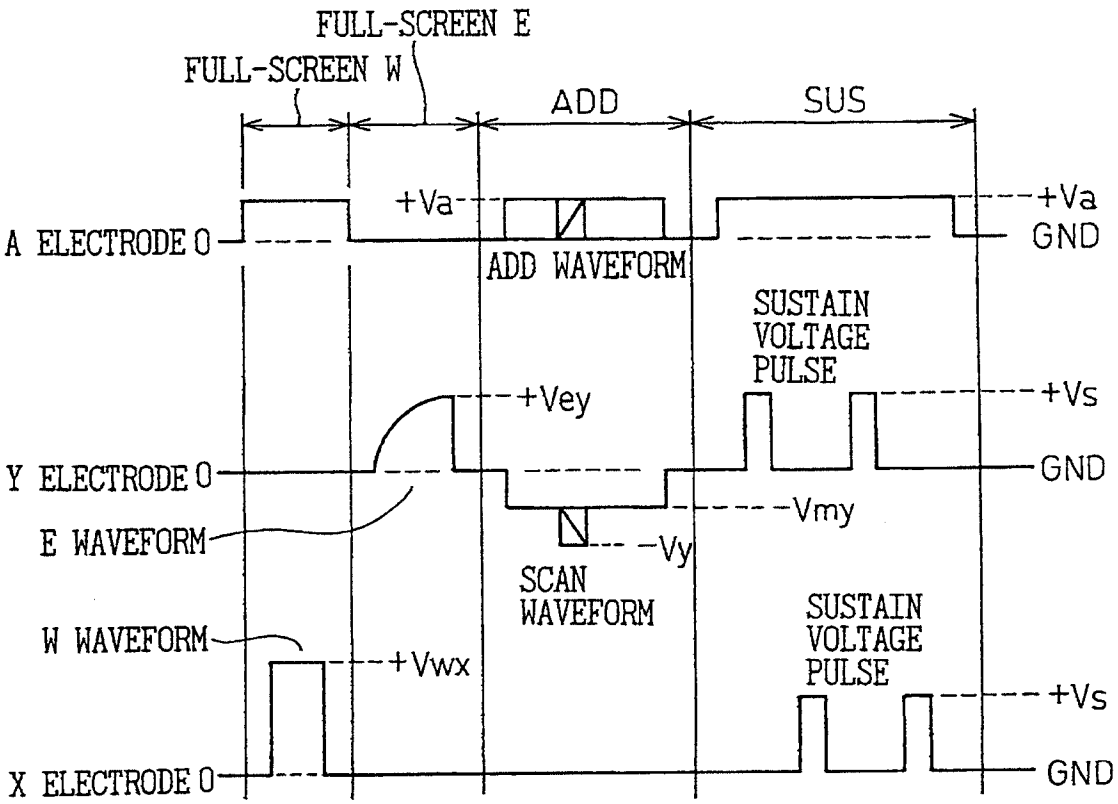
FIG. 23 is a diagram showing examples of drive waveforms for the plasma display apparatus shown in FIG. 22.

FIG. 23 is a diagram showing examples of drive waveforms for the plasma display apparatus shown in FIG. 22; the diagram schematically illustrates the voltage waveforms applied to the respective electrodes during a full-screen write period (FULL-SCREEN W), a full-screen erase period (FULL-SCREEN E), an address period (ADD), and a sustain period (sustain discharge period: SUS).

In FIG. 23, the drive periods directly related to the creation of an image display are the address period ADD and the sustain period SUS, and an image display with predetermined brightness is produced by selecting display pixels during the address period ADD and sustaining the glowing state of the selected pixels during the succeeding sustain period. Shown in FIG. 23 are the drive waveforms for one subframe when one frame is constituted of a plurality of subframes (subfields).

First, in the address period, an intermediate voltage −Vmy is applied simultaneously to all the Y electrodes (Y1 to YL), i.e., the scanning electrodes, and then, a scanning voltage pulse of −Vy level is applied in sequence from one electrode to the next. When the scanning pulse is being applied to each Y electrode, an address pulse of +Va level is applied to selected address electrodes (A1 to Ad) thereby selecting pixels on that scanning line.

In the succeeding sustain period, a common sustain voltage pulse of +Vs level is applied to all the scanning electrodes (Y1 to YL) and X-electrodes (X1 to XL) in alternating fashion, to sustain the glowing state of the selected pixels, and a display with predetermined brightness is produced by repeating this pulse application. Furthermore, grayscale representing the lightness and darkness of the image can be reproduced by controlling the number of emissions by combining the above series of basic drive waveform application operations.

The full-screen write period is initiated at predetermined intervals of time to apply a write voltage pulse to all the display cells of the panel in order to activate the display cells and maintain the display characteristic uniform. The full-screen erase period is a period for applying an erasure voltage pulse to all the display cells of the panel and thereby erasing the previous display content before initiating a new cycle of the address and sustain operations to produce an image display.

Figure 24:
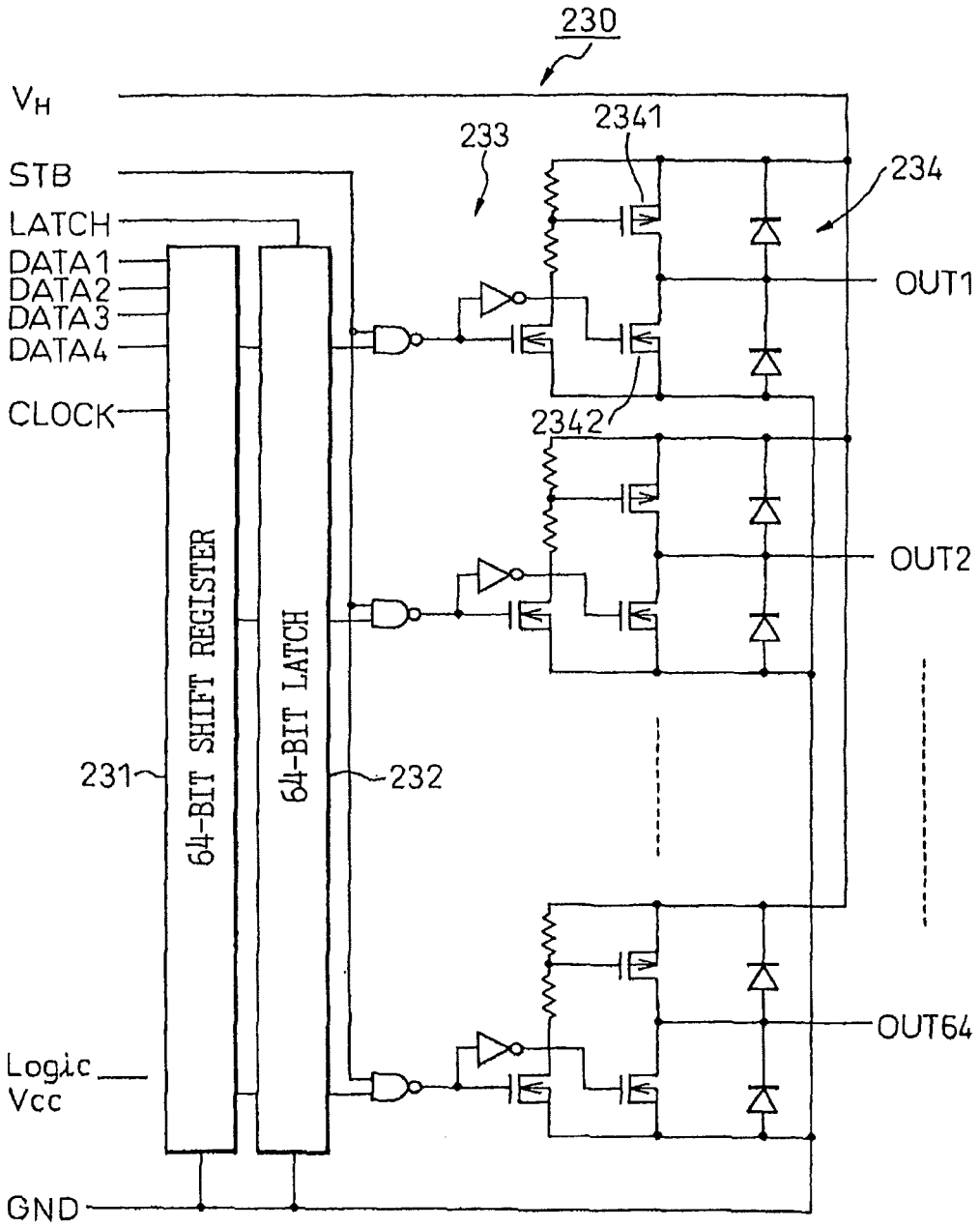
FIG. 24 is a block circuit diagram showing an example of an IC used in the plasma display apparatus shown in FIG. 22.

FIG. 24 is a block circuit diagram showing one example of an IC used in the plasma display apparatus shown in FIG. 22.

For example, when the number of address electrodes (A1 to Ad) on the display panel is 2560, a total of 40 drive ICs are used, since usually, 64-bit output drive ICs are connected to the address electrodes. Generally, these 40 drive ICs are packaged in modules each containing a plurality of drive ICs.

FIG. 24 shows the internal circuit configuration of a drive IC chip containing output circuits (234: OUT1 to OUT64) for 64 bits. Each output circuit 234 includes push-pull FETs 2341 and 2342 in the final output stage, connected between a high-voltage power supply line VH and a ground line GND. This drive IC further contains a logic circuit 233 for controlling the two FETs in each output circuit, a shift register circuit 231 for selecting the output circuits of 64 bits, and a latch circuit 232.

The control signals consist of a clock signal CLOCK and data signals DATA1 to DATA4 are sent to the shift register 231, a latch signal LATCH to the latch circuit 232, and a strobe signal STB for controlling the gate circuits. In FIG. 24, the final output stage is constructed in a CMOS configuration (2341, 2342), but a totem-pole configuration using MOSFETs of the same polarity can also be employed.

An example of a mounting method for the above drive IC chip will be described below.

For example, the drive IC chip is mounted on a rigid printed-circuit board, and the power supply, signal, and output pad terminals on the drive IC chip are connected by wire bonding to the corresponding terminals on the printed-circuit board.

Output wiring lines from the IC chip are brought out to the edges of the printed-circuit board, and output terminals are formed, which are then connected by thermo-compression to a flexible board having similar terminals, thus forming one module. Terminals for connecting to the panel display electrodes are formed at the front edge of the flexible board, and these terminals are connected to the panel display electrodes by means such as thermo-compression.

The drive terminals of all the electrodes, except the dummy loads at the panel edge, are DC isolated from circuit ground, and capacitive impedance is dominant as the load for the driving circuit. As a technique for achieving power reduction in a pulsed capacitive-load driving circuit, it is known to provide a power recovery circuit that utilizes a phenomenon of resonance for energy transfer between load capacitance and inductance. One example of the power recovery technique suitable for a driving circuit where the load capacitance varies greatly for driving each individual load electrode by a mutually independent voltage in accordance with display image, as in an address electrode driving circuit, is the low power driving circuit disclosed in Japanese Unexamined Patent Publication No. 5-249916 and described earlier with reference to FIG. 2.

Figure 25:
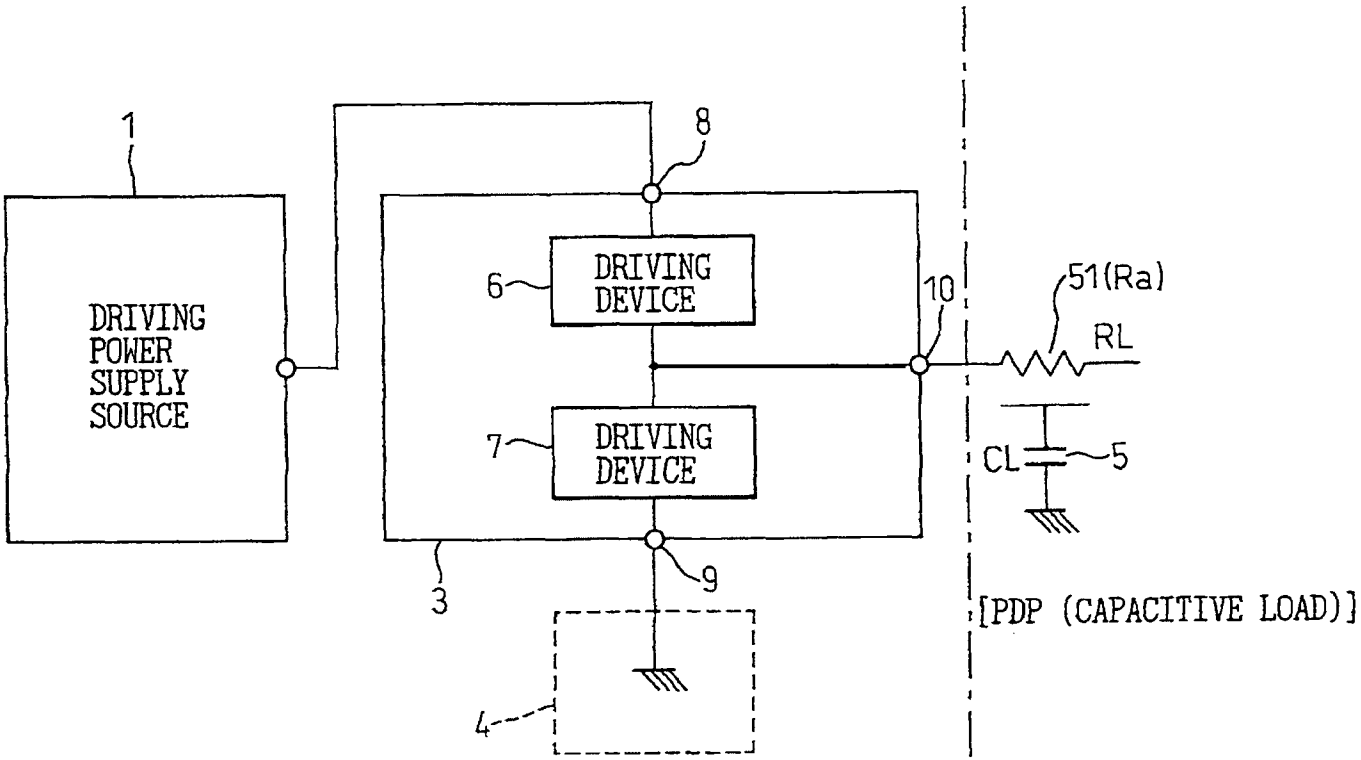
FIG. 25 is a block diagram showing a 15th embodiment of the capacitive-load driving circuit according to the present invention.

FIG. 25 is a block diagram showing a 15th embodiment of the capacitive-load driving circuit according to the present invention. In FIG. 25, reference numeral 1 is a driving power supply source, 51 is a resistive impedance (distributed resistor), 3 is an address drive IC, 4 is a reference potential point (ground point), 5 is a load capacitor, 6 and 7 are driving devices, 8 and 9 are a power supply terminal and a reference potential terminal (ground terminal), respectively, of the address drive IC, and 10 is an output terminal of the address drive IC. Reference character RL shows the value of the end-to-end resistance of the distributed resistor 51, and Ra indicates the effective electrode resistance value of the distributed resistor 51.

As shown in FIG. 25, in the capacitive-load driving circuit of the 15th embodiment, the distributed resistor (resistive impedance) 51 is connected to the output terminal 10.

For the driving electrodes of the plasma display panel (PDP), the parasitic capacitance and parasitic resistance forming the load are not concentrated, but are distributed, and the current that flows when driving the load capacitor 5 of capacitance value CL in the voltage increasing direction flows from the driving power supply source 1 through the driving device 6 in the driving circuit 3 into the distributed resistor 51 exhibiting a resistance value of Ra. On the other hand, the current that flows when driving the load capacitor 5 in the voltage falling direction flows via the driving device 7 into the reference potential point 4. That is, in either case, the drive current always passes through the distributed resistor 51 and flows via the conducting impedance of the driving device 6 or 7. In the capacitive-load driving circuit of the 15th embodiment, the electrode resistance value Ra of the distributed resistor 51 is chosen to be large enough that its resistance value cannot be ignored, that is, effectively higher than one-tenth of the resistive component of the conducting impedance of at least one of the driving devices 6 and 7. If it is assumed that the resistance value between the ends of the distributed resistor 51 is RL, and that the current leaks evenly into the parasitic capacitance from the output terminal 10 side of the driving circuit 3 and becomes zero at the end of the electrode, then the effective electrode resistance value Ra is one-third of the end-to-end resistance value RL.

The current that flows when driving the load capacitor 5 in the voltage rising direction flows from the driving power supply source 1, where the load is distributed, to the load capacitor 5 via the driving device 6 and distributed resistor 51. At this time, the power consumption is distributed in accordance with the ratio between the effective electrode resistance value Ra and the resistive impedance of the driving device 6. Likewise, when driving the load capacitor 5 in the voltage falling direction, the power consumption is distributed in accordance with the ratio between the effective electrode resistance value Ra and the resistive impedance of the driving device 7. Here, if it is possible to insert a resistive member in series in the path of the drive current flowing to the capacitor part (5), the resistive member can, of course, be inserted between the capacitor part and the output terminal 10 of the driving circuit 3 or be connected to the output terminal 10 of the driving circuit via the capacitor part.

Unlike the case that employs the prior known power recovery method utilizing a phenomenon of resonance, the power reducing effect in the above driving circuit 3 does not degrade even if the load capacitor 5 or the driving speed is increased. Thus, the capacitive-load driving circuit of the 15th embodiment can reduce the power consumed in the driving circuit (drive IC) 3, making it possible to simplify the heat sinking structure of the driving circuit 3 and reduce the cost of the circuit.

A flat panel display apparatus and, in particular, a plasma display apparatus whose trend is toward a larger-screen and higher-resolution display and whose drive voltage is high, requires the use of many load capacitors and many display panel driving circuits operating at high driving speed; therefore, when the 15th embodiment is applied to such display apparatus, the cost of the driving circuits and their heat removal mechanism can be drastically reduced. More specifically, in a plasma display apparatus, since high-voltage LSIs have to be mounted in a very limited space, the proportion of the cost of the driving circuits and their heat removal mechanism to the total cost of the display apparatus is relatively high; therefore, if the power consumption (heat generation) in each driving circuit is distributed by applying the present embodiment, the cost of the driving circuit and its heat removal mechanism can be drastically reduced. The power reducing effect in the driving circuit can also be achieved when the driving circuit 3 is implemented as an integrated circuit for driving a plurality of load capacitors.

Figure 26:
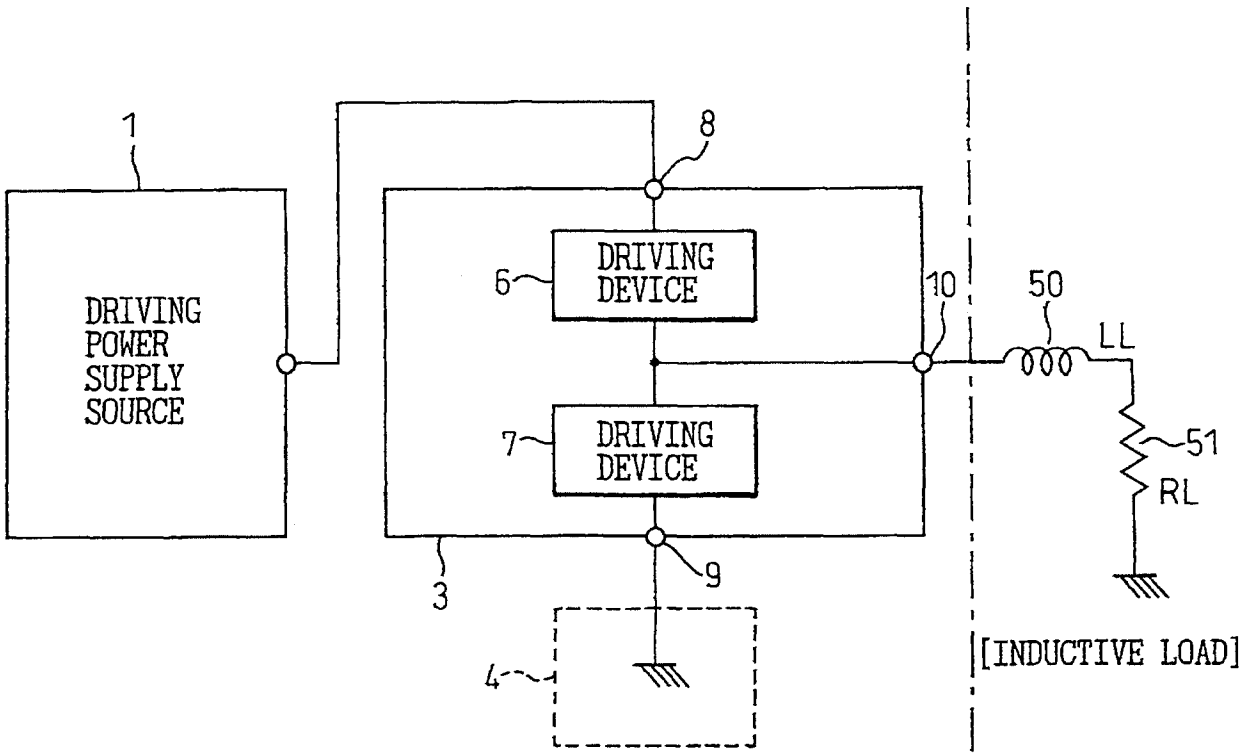
FIG. 26 is a block diagram showing a 16th embodiment of the capacitive-load driving circuit according to the present invention.

FIG. 26 is a block diagram showing a 16th embodiment of the capacitive-load driving circuit according to the present invention. In FIG. 26, reference numeral 50 indicates an inductive load.

As is apparent from a comparison between FIG. 25 and FIG. 26, the capacitive load 5 in the 15th embodiment shown in FIG. 25 is replaced by the inductive load 50 in the 16th embodiment. The resistive impedance 51 is provided for the output terminal 10 of the driving circuit 3; therefore, the configuration can be applied not only to the driving circuit for driving the capacitive load 5 but also to the driving circuit for driving the inductive load 50. Examples of the inductive load 50 include deflection coils used in a television receiver or an oscilloscope for deflecting electron beams in a cathode-ray tube, and coils used in a speaker, motor, actuator, etc. When driving such inductive loads, if the resistor 51 is inserted in series that provides an effective resistance value higher than one-tenth of the conducting impedance of at least one of the driving devices 6 and 7 by increasing the coil winding resistance or by inserting a series resistor, the power consumption (heat generation) of the driving circuit 3 can be reduced by distributing the power.

Figure 27:
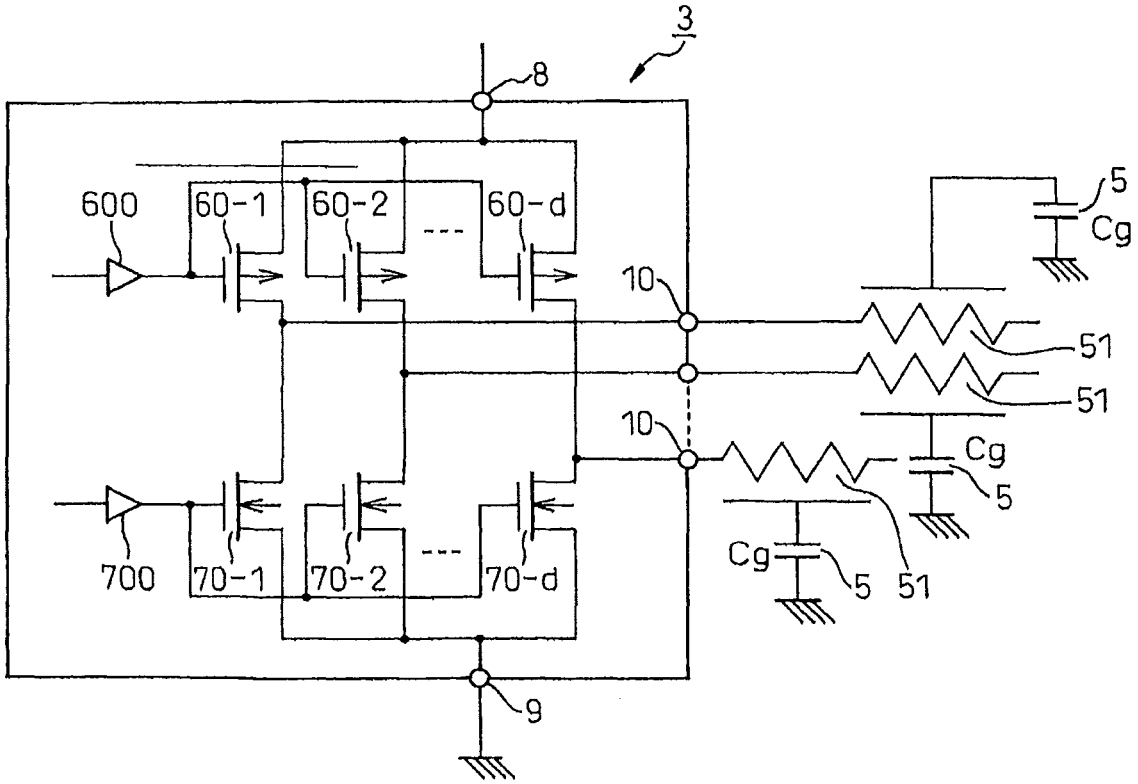
FIG. 27 is a circuit diagram of a CMOS-type address drive IC as a 17th embodiment of the capacitive-load driving circuit according to the present invention.

FIG. 27 is a circuit diagram of a CMOS-type address drive IC as a 17th embodiment of the capacitive-load driving circuit according to the present invention. The driving circuit (address drive IC) 3 in the capacitive-load driving circuit of the 17th embodiment is the same as that shown in FIG. 15.

As shown in FIG. 27, in the 17th embodiment, the present invention is applied to the address drive IC 3 for driving, for example, the number, d, address lines (A1 to Ad) in a plasma display apparatus, and the drive IC itself is identical in configuration to that shown in FIG. 15. That is, the drive IC 3 employs a CMOS configuration using pMOS transistors for pullup-side driving devices 60-1 to **60-*d* and nMOS transistors for pulldown-side driving devices 70-1 to 70-*d*, and the pullup- and pulldown-side driving devices are driven from the driving stages 600 and 700**, respectively.

Distributed resistors 51, 51, . . . , 51, each similar to the one described with reference to FIG. 25, are provided for the output terminals 10, 10, . . . , 10 connected to the respective pullup/pulldown driving device pairs 60-1/70-1, 60-2/70-2, . . . , **60-*d*/70-*d*, thereby reducing the power consumption in the drive IC 3 and hence suppressing temperature rise in the drive IC. FIG. 27 has shown the CMOS-type address drive IC, but it will be appreciated that the present invention can also be applied to a totem-pole type driving circuit using MOS transistors (NMOS transistors) of the same polarity, as previously shown in FIG. 14. Further, in FIG. 27, only the capacitance Cg between counter electrodes, previously illustrated in FIG. 21, has been shown as the load capacitance 5** by assuming the case where the drive voltage is the same between adjacent electrodes, but it will be recognized that in the case where the drive voltage is different between adjacent electrodes, for example, the load capacitance (CL) is the sum of the counter electrode capacitance Cg and the adjacent electrode capacitance Ca not shown. In that case, the maximum value of the effective series resistance Ra is ⅔RL, that is, the combined effective resistance of the adjacent electrodes.

Figure 28A:
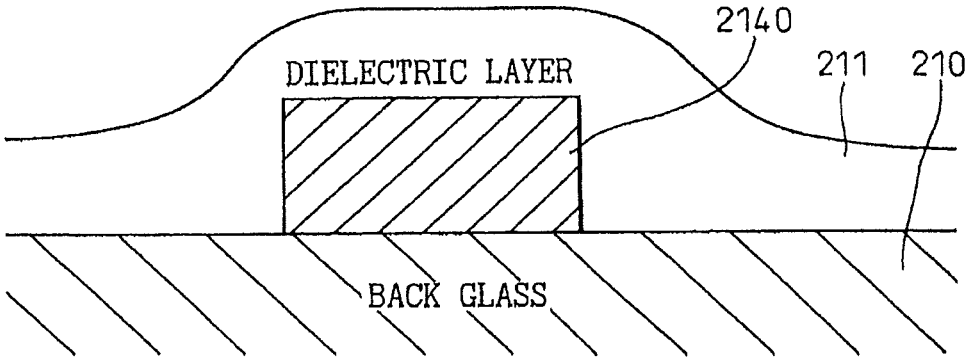
FIG. 28A and FIG. 28B are cross-sectional views each showing an address electrode in a plasma display panel to which the capacitive-load driving circuit according to the present invention is applied.
Figure 28B:
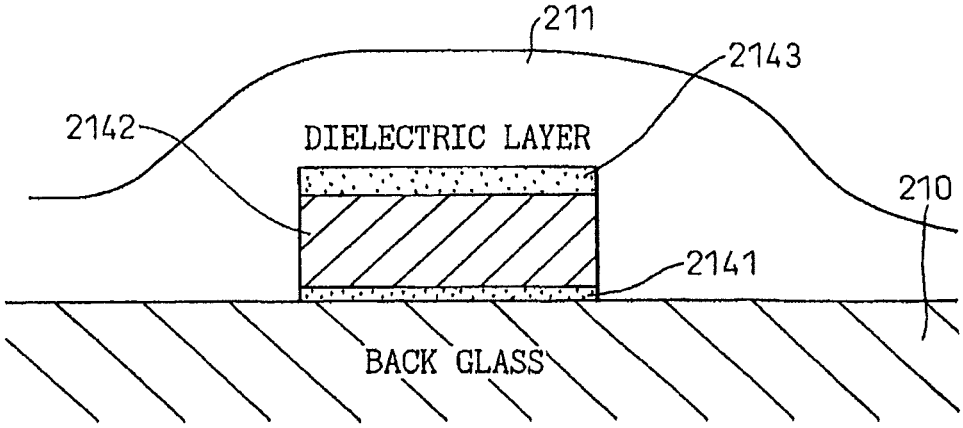

FIGS. 28A and 28B are cross-sectional views each showing an address electrode in a plasma display panel to which the capacitive-load driving circuit according to the present invention is applied: FIG. 28A shows an example of an electrode formed from a single material, and FIG. 28B shows an example of an electrode formed from a composite material. In FIG. 28A, reference numeral 210 is a back glass substrate, 211 is a dielectric layer, and 2140 is a metal layer. In FIG. 28B, reference numeral 2141 is a contact material layer, 2142 is a main material layer, and 2143 is an exposed layer.

When the electrode is formed from a single material as shown in FIG. 28A, to increase the value RL of the distributed resistor (51) to the desired resistance value the cross-sectional area of the electrode is reduced by reducing either the thickness or width of the metal layer 2140 forming the electrode. Silver, chrome, or other material that provides good adhesion to the back glass substrate 210 and the dielectric layer 211, and that has excellent processability and excellent weatherability when exposed, is advantageous in terms of cost, and has excellent reliability, can be used for the metal layer 2140. Here, reduced thickness of the electrode means that the etching performed when patterning the electrode can be accomplished in a shorter time; hence, the manufacturing time can be shortened. This also offers the advantage of being able to reduce the cost since the materials used, such as the electrode material and etchant, can be reduced.

When the electrode is formed from a composite material as shown in FIG. 28B, to increase the value RL of the distributed resistor (51) to the desired resistance value the cross-sectional area may be reduced, as in the single material case described above (for example, by reducing the thickness of the main material layer 2142 that greatly contributes to the resistance of the electrode), but if the conditions permit, the main material layer 2142 itself can be omitted in its entirety. Here, copper or other material that offers advantages in terms of electrode resistance control, processability, and cost is used for the main material layer 2142, and chrome or other material that provides good adhesion to the back glass substrate 210 and the main material 2142, is advantageous in terms of cost, and has excellent reliability, is used for the contact material layer 2141, while chrome or other material that provides good adhesion to the main material 2142 and the dielectric layer, and that has excellent weatherability when exposed, is advantageous in terms of cost, and has excellent reliability, is used for the exposed layer 2143. The main material layer 2142 of copper or the like is formed, for example, by sputtering, and reduced thickness of this main material layer 2142 directly leads to the shortening of the time required for the sputtering; furthermore, omission of the main material layer 2142 means omitting the manufacturing step for that layer, and thus contributes to shortening the manufacturing time and reducing the cost.

Figure 29:
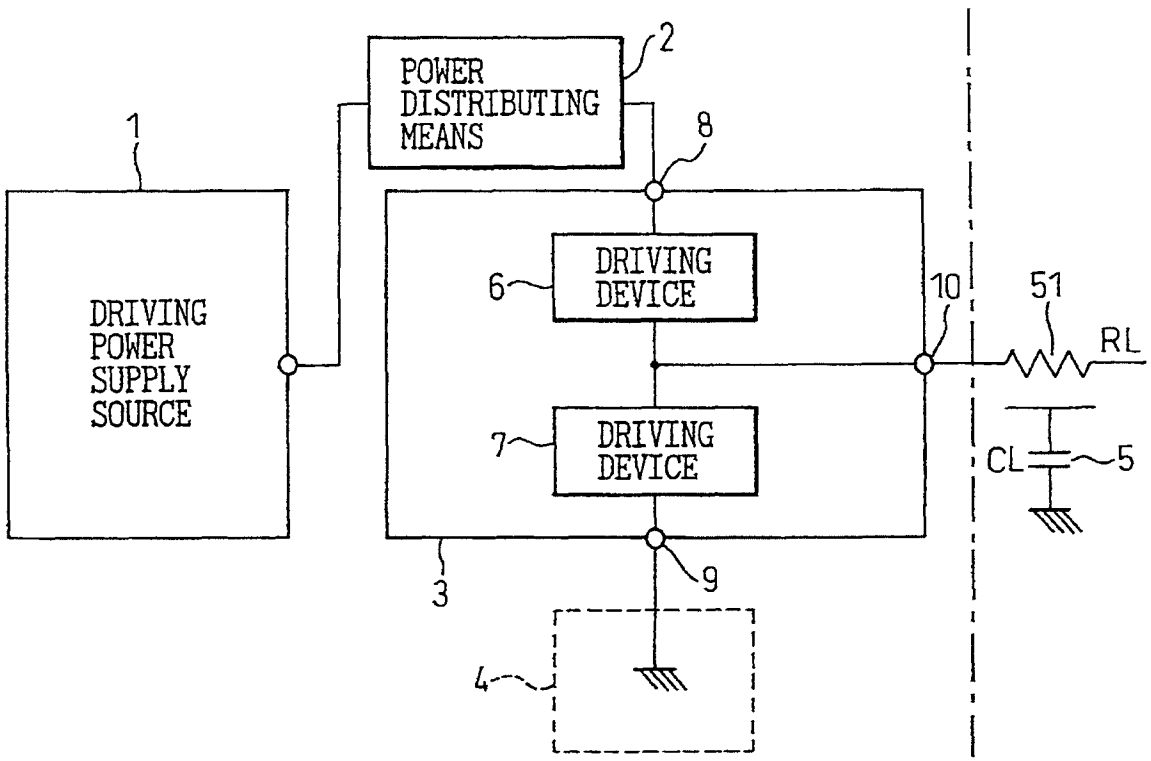
FIG. 29 is a block diagram showing an 18th embodiment of the capacitive-load driving circuit according to the present invention.

FIG. 29 is a block diagram showing an 18th embodiment of the capacitive-load driving circuit according to the present invention, in which the power distributing means 2 shown in FIG. 3, for example, is applied to the 15th embodiment shown in FIG. 25.

The power distributing means 2, etc. shown here can be implemented in various configurations as explained, for example, with reference to FIGS. 4 to 19; in that case, the power consumption distribution effect for the driving circuit 3, achieved in each configuration, can be obtained in addition to the effect achieved in the 15th embodiment.

As described in detail above, the present invention achieves a capacitive-load driving circuit capable of distributing temperature rise (power consumption) in a circuit that drives a capacitive load, and a plasma display apparatus using such a driving circuit.

Many different embodiments of the present invention may be constructed without departing from the spirit and scope of the present invention, and it should be understood that the present invention is not limited to the specific embodiments described in this specification, except as defined in the appended claims.

What is claimed is:

1. A flat panel display apparatus comprising a display panel having a plurality of display cells and a driving circuit for driving the display panel, the driving circuit including:

a driving power supply source to generate a driving voltage;

a driving module in which a drive IC to drive the plurality of display cells of the display panel and a power supply terminal to supply power to the drive IC are formed to be a module; and a power distributor that is arranged outside the driving module and that is connected between the driving power supply source and the power supply terminal of the driving module, and the driving voltage being supplied to the power supply terminal of the driving module via the power distributor, wherein an impedance of the power distributor is equal to or higher than one-tenth of a conductive impedance of the drive IC.

2. The flat panel display apparatus according to claim 1, wherein the power distributor is a resistive element.

3. The flat panel display apparatus according to claim 1, wherein the driving module includes a plurality of drive ICs.

* * * * *